US010410518B2

(12) United States Patent
Peng

(10) Patent No.: US 10,410,518 B2
(45) Date of Patent: Sep. 10, 2019

(54) ROAD CONDITION INFORMATION TRANSMISSION METHOD AND APPARATUS, AND ROAD CONDITION INFORMATION OBTAINING METHOD

(71) Applicant: TENCENT TECHNOLOGY (SHENZHEN) COMPANY LIMITED, Shenzhen (CN)

(72) Inventor: Dajing Peng, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 0 days.

(21) Appl. No.: 15/969,875

(22) Filed: May 3, 2018

(65) Prior Publication Data

US 2018/0247533 A1 Aug. 30, 2018

Related U.S. Application Data

(63) Continuation of application No. PCT/CN2017/091710, filed on Jul. 4, 2017.

(30) Foreign Application Priority Data

Jul. 9, 2016 (CN) ..... 2016 1 0539528

(51) Int. Cl.
*G08G 1/0967* (2006.01)

(52) U.S. Cl.
CPC . *G08G 1/096775* (2013.01); *G08G 1/096716* (2013.01); *G08G 1/096741* (2013.01)

(58) Field of Classification Search
CPC combination set(s) only.
See application file for complete search history.

(56) References Cited

U.S. PATENT DOCUMENTS 6,615,130 B2 9/2003 Myr
2003/0033078 A1 2/2003 Kita et al.
(Continued)

FOREIGN PATENT DOCUMENTS

CN 101097150 A 1/2008
CN 101246021 A 8/2008
(Continued)

OTHER PUBLICATIONS

Office Action dated Jun. 8, 2018 in Chinese Application No. 201610539528.5 (w/English translation).
(Continued)

*Primary Examiner* — Nabil H Syed
*Assistant Examiner* — Cal J Eustaquio
(74) *Attorney, Agent, or Firm* — Oblon, McClelland, Maier & Neustadt, L.L.P.

(57) ABSTRACT

The present disclosure discloses a road condition information transmission method and apparatus and a road condition information obtaining method. The road condition information transmission method comprises: receiving a road condition information request sent by a first client, the road condition information request being used to request road condition information; obtaining a current location of the first client; determining a target subsequent road segment from a plurality of candidate subsequent road segments of the current location, the target subsequent road segment being determined according to recorded road segment information; and transmitting road condition information of the target subsequent road segment to the first client.

17 Claims, 13 Drawing Sheets

(56) References Cited

U.S. PATENT DOCUMENTS

| | | | | |
|---|---|---|---|---|
| 2014/0368361 | A1* | 12/2014 | Leblanc | G08G 1/096811 340/995.12 |
| 2016/0356922 | A1* | 12/2016 | McCann | G01W 1/10 |

FOREIGN PATENT DOCUMENTS

| | | | |
|---|---|---|---|
| CN | 101807348 | A | 8/2010 |
| CN | 102278991 | A | 12/2011 |
| CN | 103134508 | A | 6/2013 |
| CN | 103398715 | A | 11/2013 |
| CN | 103606292 | A | 2/2014 |
| CN | 106205161 | A | 12/2016 |

OTHER PUBLICATIONS

Written Opinion of the International Searching Authority dated Sep. 22, 2017 in PCT/CN2017/091710, p. 1-4.
International Search Report of PCT/CN2017/091710 (w/English translation).

* cited by examiner

ROAD CONDITION INFORMATION TRANSMISSION METHOD AND APPARATUS, AND ROAD CONDITION INFORMATION OBTAINING METHOD

RELATED APPLICATIONS

This application is a continuation of International Application No. PCT/CN2017/091710, filed on Jul. 4, 2017, which claims priority to Chinese patent application No. 201610539528.5, entitled "ROAD CONDITION INFORMATION TRANSMISSION METHOD AND APPARATUS" filed on Jul. 9, 2016 in the Chinese Patent Office. The entire disclosures of the prior applications are incorporated by reference in their entirety.

FIELD OF THE TECHNOLOGY

The present disclosure relates to the field of computers, and in particular to a road condition information transmission method and apparatus, and a road condition information obtaining method.

BACKGROUND OF THE DISCLOSURE

With the continuous increase in the number of vehicles, road congestion has become more and more serious. In order to shorten the travel time of a user and avoid congested road segments, in the related technology, a server receives the current location information of the user returned by a client in a state of map cruising, searches for the road condition information of the road ahead based on the current location information, and sends the obtained road condition information of the road ahead to the client, so as to indicate the road congestion situation to the user. In the related technology, the server does not recognize the current driving direction of the user when obtaining the road condition information, and only searches for the road condition information of the road ahead, if the road ahead is not the road indicated by the driving direction of the client, it will lead to low accuracy of the road condition information sent to the client, and the user needs to view the required road condition information by manually dragging a base map, resulting in inconvenience for the user.

In view of the above problems, no effective solution has yet been proposed.

SUMMARY

The embodiments of the present disclosure provide a road condition information transmission method and apparatus, and a road condition information obtaining method, to at least solve the technical problem that in the related technology, the server can only send the road condition information of the road ahead to the client, leading to low accuracy of the road condition information sent to the client.

According to one aspect of the embodiments of the present disclosure, a road condition information transmission method is provided which is implemented by processing circuitry of a road condition information transmission apparatus and comprises: receiving a road condition information request sent by a first client, the road condition information request being used to request road condition information; obtaining a current location of the first client; determining a target subsequent road segment from a plurality of candidate subsequent road segments of the current location, the target subsequent road segment being determined according to recorded road segment information; and transmitting road condition information of the target subsequent road segment to the first client.

According to another aspect of the embodiments of the present disclosure, a road condition information transmission apparatus is further provided and comprises: processing circuitry configured to receive a road condition information request sent by a first client, the road condition information request being used to request road condition information; obtain a current location of the first client; determine a target subsequent road segment from a plurality of candidate subsequent road segments of the current location, the target subsequent road segment being determined according to recorded road segment information; and transmit road condition information of the target subsequent road segment to the first client.

According to another aspect of the embodiments of the present disclosure, a road condition information transmission method is further provided which is implemented by processing circuitry of a road condition information transmission apparatus and comprises: sending, by a first client, a road condition information request to a server, the road condition information request being used to request road condition information; and receiving, by the first client, road condition information of a target subsequent road segment that is transmitted by the server, the target subsequent road segment being a subsequent road segment determined by the server from a plurality of candidate subsequent road segments of a current location of the first client after the server obtains the current location, and the target subsequent road segment being determined according to recorded road segment information.

According to another aspect of the embodiments of the present disclosure, a road condition information obtaining method is further provided which is implemented by processing circuitry of a road condition information transmission apparatus and comprises: obtaining a current location of a first client; determining a target subsequent road segment from a plurality of candidate subsequent road segments of the current location, the target subsequent road segment being determined according to recorded road segment information; and obtaining road condition information of the target subsequent road segment.

In the embodiments of the present disclosure, the method of receiving a road condition information request sent by a first client, the road condition information request being used to request road condition information; obtaining a current location of the first client; determining a target subsequent road segment from a plurality of candidate subsequent road segments of the current location, the target subsequent road segment being determined according to recorded road segment information; and transmitting road condition information of the target subsequent road segment to the first client is adopted, by determining the target subsequent road segment from the plurality of candidate subsequent road segments according to the recorded road segment information after receiving the road condition information request, and sending the road condition information of the target subsequent road segment to the first client, the purpose of sending road condition information to the client in a targeted mode is realized, accordingly the technical effect of improving the accuracy of the road condition information sent to the client is realized, and as a result, the technical problem that in the related technology, the server can only send the road condition information of the road ahead to the client, leading to low accuracy of the road condition information sent to the client is solved.

BRIEF DESCRIPTION OF THE DRAWINGS

The drawings described herein are provided to provide a further understanding of the present disclosure, and constitute a part of the present application. The exemplary embodiments of the present disclosure and descriptions thereof are used to explain the present disclosure, and do not constitute improper limitations of the present disclosure. In the drawings.

DESCRIPTION OF EMBODIMENTS

In order to make those skilled in the art better understand the solutions of the present disclosure, the technical solutions in the embodiments of the present disclosure will be described clearly and completely in the following with reference to the accompanying drawings in the embodiments of the present disclosure. Obviously, the described embodiments are merely a part of the embodiments of the present disclosure, rather than all the embodiments. All other embodiments obtained by those of ordinary skill in the art based on the embodiments of the present disclosure without creative efforts shall fall within the protection scope of the present disclosure.

It should be noted that the terms "first", "second", and the like in the specification and claims of the present disclosure and the foregoing drawings are used to distinguish similar objects and do not necessarily describe a specific sequence or order. It should be understood that the data used as such may be interchanged where appropriate so that the embodiments of the present disclosure described herein can be implemented in other than the order illustrated or described herein. In addition, the terms "comprise" and "have" and any variations thereof are intended to cover non-exclusive inclusions. For example, a process, method, system, product, or apparatus that comprises a series of steps or units need not be limited to those steps or units that are clearly listed, but may include other steps or units that are not explicitly listed or inherent to these processes, methods, products, or apparatuses.

Embodiment 1

According to the embodiments of the present disclosure, method embodiments of a road condition information transmission method and a road condition information obtaining method are provided.

Figure 1:
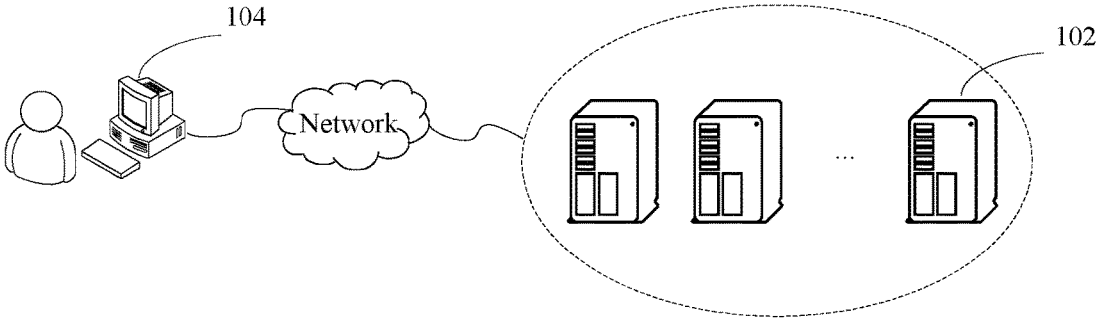
FIG. 1 is a schematic diagram of a hardware environment of a road condition information transmission method according to the embodiments of the present disclosure.

Alternatively, in the present embodiments, the foregoing road condition information transmission method and road condition information obtaining method may be applied to a hardware environment constituted by a server 102 and a terminal 104 as shown in FIG. 1. As shown in FIG. 1, the server 102 is connected to the terminal 104 through a network, the network comprises, but is not limited to, a wide area network, a metropolitan area network, or a local area network, and the terminal 104 is not limited to a PC, a mobile phone, a tablet computer, or the like. The road condition information transmission method according to the embodiments of the present disclosure may be executed by the server 102, may also be executed by the terminal 104, and may also be executed jointly by the server 102 and the terminal 104. The way that the terminal 104 executes the road condition information transmission method according to the embodiments of the present disclosure may also be by a client installed thereon. The road condition information obtaining method according to the embodiments of the present disclosure may be executed by the terminal 104, wherein the way that the terminal 104 executes the road condition information obtaining method according to the embodiments of the present disclosure may also be by a client installed thereon.

The following describes in detail the server executing the road condition information transmission method according to the embodiments of the present disclosure.

Figure 2:
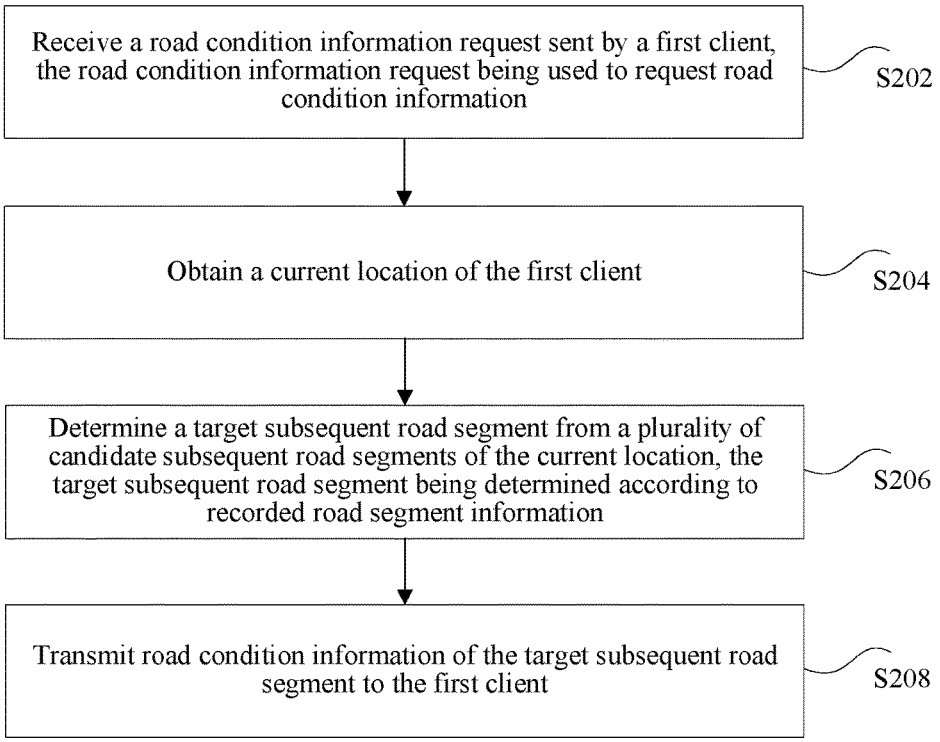
FIG. 2 is a flowchart of an alternative road condition information transmission method according to the embodiments of the present disclosure.

FIG. 2 is a flowchart of an alternative road condition information transmission method according to the embodiments of the present disclosure. As shown in FIG. 2, the method may comprise the following steps:

Step S202: Receive a road condition information request sent by a first client, the road condition information request being used to request road condition information.

Step S204: Obtain a current location of the first client.

Step S206: Determine a target subsequent road segment from a plurality of candidate subsequent road segments of the current location, the target subsequent road segment being determined according to recorded road segment information.

Step S208: Transmit road condition information of the target subsequent road segment to the first client.

By means of steps S202-S208, by determining the target subsequent road segment from the plurality of candidate subsequent road segments according to the recorded road segment information after receiving the road condition information request, and sending the road condition information of the target subsequent road segment to the first client, the purpose of sending road condition information to the client in a targeted mode is realized, accordingly the technical problem that in the related technology, the server can only send the road condition information of the road ahead to the client, leading to low accuracy of the road condition information sent to the client is solved, and the technical effect of improving the accuracy of the road condition information sent to the client is realized.

In the technical solution provided in step S202, the embodiments of the present disclosure do not specifically limit the type of the first client, for example, the first client may be an application client. The first client may be installed in a terminal device. The embodiments of the present disclosure do not specifically limit the type of the terminal device where the first client is located either, for example, the terminal device may be a mobile phone, a tablet computer and the like. The first client may have functions such as map navigation and road condition information broadcasting, such as a vehicle navigation application. The first client may also have communication functions including wired communication and wireless communication, such as Bluetooth and WiFi. The first client can use the communication functions to communicate with the server for data exchange and information transfer. The first client may send a road condition information request to the server by communicating with the server, wherein the road condition information request may be used to request road condition information. It should be noted that the road condition information request sent by the first client has a real-time nature, that is, the road condition information requested by the road condition information request is real-time road condition information. The real-time nature of the road condition information request may be reflected by the real-time nature of the location information of the first client. The road condition information requested by the road condition information request sent by the first client to the server is the road condition information corresponding to the current location of the first client, and when the location information of the first client changes, the road condition information requested by the road condition information request is also updated in real time accordingly.

In an actual application scenario, the first client may be automatically triggered to send the road condition information request to the server to obtain real-time road condition information when being started, alternatively, the first client may also detect the touch operation performed by the user in real time after being started and initialized, and is triggered to send the road condition information request to the server after detecting the touch operation performed by the user. For example, the first client is a map application installed in a mobile phone. After the user starts the map application, the map application may detect the touch operation performed by the user in a screen of the mobile phone in real time. The touch operation may include, but is not limited to, clicking (for example, single click and double clicks), long press, gesture, swipe, drag of a base map, and so on. When the map application detects any one of the touch operation described above, a road condition information request may be sent to the server.

In the technical solution provided in step S204, after receiving the road condition information request sent by the first client, the server may obtain the current location of the first client by using a GPS positioning module. It should be noted that the GPS positioning module may be located in the terminal device where the first client is located, or may be embedded in the first client as a functional program code, and the server obtains the current location of the first client by receiving coordinate information reported by the GPS positioning module in real time. Alternatively, the road condition information request sent by the first client may carry the current location information of the first client. After receiving the road condition information request sent by the first client, the server may parse the road condition information request, so as to obtain the current location of the first client therefrom. It should be noted that the embodiments of the present disclosure do not specifically limit the way of obtaining the current location of the first client, and the current location of the first client may also be obtained through other ways, which will not be described here by way of example.

Figure 3:
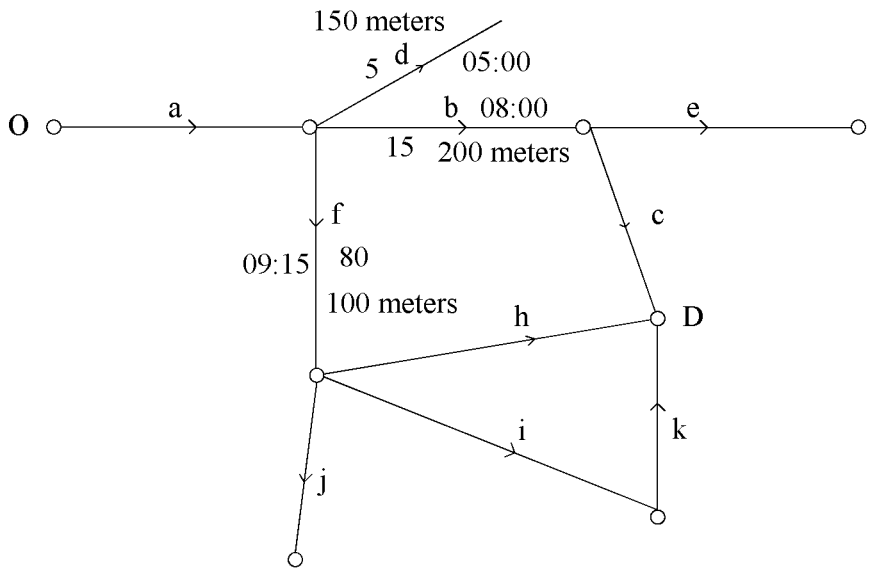
FIG. 3 is a schematic diagram of an alternative recorded road segment in recorded road segment information according to the embodiments of the present disclosure.

In the technical solution provided in step S206, a large amount of recorded road segment information may be pre-stored in the server, and a plurality of road segments may be recorded in the recorded road segment information. These road segments may be road segments already completed by the first client, or road segments completed by other clients, or a set of road segments completed by the first client and other clients. The road segments recorded in the recorded road segment information may be marked by identifiers. For example, as shown in FIG. 3, ten road segments are recorded in the recorded road segment information, and the road segments are represented by a, b, c, d, e, f, h, i, j and k respectively. The attribute parameters of each road segment may be recorded in the recorded road segment information, and the attribute parameters of each road segment may include, but are not limited to, the length of the road segment, the number of recording times of the road segment and the like. For example, as shown in FIG. 3, the number of recording times of the road segment b is 15, the length is 200 meters, the number of recording times of the road segment d is 5, the length is 150 meters, the number of recording times of the road segment f is 80, and the length is 100 meters. It should be noted here that the number of recording times and length of other road segments are not shown in FIG. 3.

After the current location of the first client is obtained, a plurality of candidate subsequent road segments of the current location of the first client may be determined according to the recorded road segment information. It should be noted that the embodiments of the present disclosure provide the following two alternative methods for determining the plurality of candidate subsequent road segments of the current location of the first client, specifically:

The first alternative determining method comprises: obtaining destination information after obtaining the current location of the first client, and determining the plurality of candidate subsequent road segments of the current location of the first client according to the current location of the first client and the obtained destination information. It should be noted that the destination information may be location information preset by the user in the first client. After a destination is determined, all passable routes from the current location of the first client to the destination may be obtained according to the recorded road segment information, and then the plurality of candidate subsequent road segments of the current location of the first client can be determined based on these passable routes. For example, as shown in FIG. 3, assuming that O is a start point, D is an end point and the current location of the first client is located on road segment a, all passable routes from the current location of the first client to the end point D are a-b-c, a-f-h and a-f-i-k, and according to these passable routes, it can be determined that the candidate subsequent road segments of the current location of the first client are road segment b and road segment f respectively. It should be noted that the foregoing method for determining the plurality of candidate subsequent road segments of the current location of the first client is more applicable to the case when a destination is known in advance.

The second alternative determining method comprises: obtaining a driving direction of the first client after obtaining the current location of the first client, and determining the plurality of candidate subsequent road segments of the current location of the first client according to the current location and driving direction of the first client. It should be noted that the driving direction of the first client may be obtained by obtaining the location information at the first moment and the second moment, and taking the direction from the location where the first client is located at the first moment to the location where the first client is located at the second moment as the driving direction of the first client. After determining the driving direction of the first client, a plurality of passable road segments indicated by the driving direction of the first client may be determined as the plurality of candidate subsequent road segments of the current location of the first client. For example, as shown in FIG. 3, assuming that the current location of the first client is located on road segment a and the driving direction is as indicated by the arrow in the figure, it can be determined that the passable road segments indicated by the driving direction include road segment b, road segment d, and road segment f, and the plurality of candidate subsequent road segments of the current location of the first client are road segment b, road segment d, and road segment f. It should be noted that the foregoing method for determining the plurality of candidate subsequent road segments of the current location of the first client is more applicable to a case when the destination is unknown.

It should be noted that the embodiments of the present disclosure may also comprise other methods for determining the plurality of candidate subsequent road segments of the current location of the first client, which will not be described here by way of example. In the embodiments of the present disclosure, a method for determining the plurality of candidate subsequent road segments of the current location of the first client may be selected according to actual requirements.

After the plurality of candidate subsequent road segments of the current location of the first client are determined, a target subsequent road segment may be determined from the plurality of candidate subsequent road segments according to the attribute parameters of each candidate subsequent road segment in the recorded road segment information, wherein the target subsequent road segment is the next driving road segment of the first client, and the attribute parameters of each road segment that can be recorded in the recorded road segment information may include the length of the road segment, the number of recording times of the road segment and the like. The length of the road segment can affect the driving time and fuel consumption of the first client, and the user tends to select a road segment with a shorter distance during actual driving. The number of recording times of the road segment can be used to indicate the probability that the user selects the road segment, that is, the larger the number of recording times of the road segment is, the higher the probability that the user will select the road segment during actual driving is.

As an alternative embodiment, the determination of the target subsequent road segment according to recorded road segment information may comprise: Step 2061: Obtain the length of each candidate subsequent road segment in the recorded road segment information. Step 2063: Determine a candidate subsequent road segment having the shortest length as the target subsequent road segment. For example, as shown in FIG. 3, assuming that the current location of the first client is located on road segment a, the plurality of candidate subsequent road segments of the current location of the first client determined based on the recorded road segment information are road segment b, road segment d, and road segment f, the length of road segment b is 200 meters, the length of road segment d is 150 meters, the length of road segment f is 100 meters, and then it can be determined that the target subsequent road segment is road segment f having the shortest length by referring to the attribute parameter, road segment length. The target subsequent road segment determined by the alternative embodiment has the shortest length, so that driving time can be effectively shortened and fuel consumption can be reduced.

As another alternative embodiment, the determination of the target subsequent road segment according to the recorded road segment information may comprise the following steps: Step 2062: Obtain the number of recording times of each candidate subsequent road segment in the recorded road segment information. Step 2064: Determine a candidate subsequent road segment having the largest number of recording times as the target subsequent road segment. For example, as shown in FIG. 3, assuming that the current location of the first client is located on road segment a, the plurality of candidate subsequent road segments of the current location of the first client determined based on the recorded road segment information are road segment b, road segment d, and road segment f, the number of recording times of the road segment b is 15, the number of recording times of the road segment d is 5, the number of recording times of the road segment f is 80, and then it can be determined that the target subsequent road segment is the road segment f having the largest number of recording times by referring to the attribute parameter, the number of recording times. The target subsequent road segment determined by the alternative embodiment has the largest number of recording times, which is more in line with the travel habits and travel requirements of the user.

It should be noted that in the actual application scenario, the target subsequent road segment may be determined by any one of the foregoing two alternative embodiments according to actual requirements. However, considering that there may be a plurality of target subsequent road segments determined by using a single attribute parameter, for example, it is determined that a plurality of candidate subsequent road segments having the shortest length exist in the plurality of candidate subsequent subsequent road segments of the current location of the first client according to the attribute parameter, road segment length, at this time, in the embodiment of the present disclosure, the numbers of recording times of the plurality of candidate subsequent road segments having the shortest length can be obtained from the recorded road segment information, and a candidate subsequent road segment having the largest number of recording times is selected from the plurality of candidate subsequent road segments having the shortest length as the target subsequent road segment according to the number of recording times of road segments. It should be noted that if there are a plurality of candidate subsequent road segments having the largest number of recording times in the plurality of candidate subsequent road segments having the shortest length, any one of the candidate subsequent road segments can be randomly selected as the target subsequent road segment. For another example, it is determined that a plurality of candidate subsequent road segments having the the largest number of recording times exist in the plurality of candidate subsequent subsequent road segments of the current location of the first client according to the attribute parameter, the number of recording times, at this time, in the embodiment of the present disclosure, the length of each of the plurality of candidate subsequent road segments having the largest number of recording times can be obtained from the recorded road segment information, and a candidate subsequent road segment having the shortest length is selected from the plurality of candidate subsequent road segments having the largest number of recording times as the target subsequent road segment according to road segment length. It should be noted that if there are a plurality of candidate subsequent road segments having the shortest length in the plurality of candidate subsequent road segments having the largest number of recording times, any one of the candidate subsequent road segments can be randomly selected as the target subsequent road segment. The target subsequent road segment determined by the above determining method in the embodiment of the present disclosure has higher accuracy and is more in line with the actual needs of the user. Road condition information of the target subsequent road segment determined by the above determining method can be transmitted to the user more accurately, and is more in line with the actual needs of the user.

It should also be noted that the number of recording times of each candidate subsequent road segment in the recorded road segment information may also be expressed in the form of transition probability, and the transition probability of each candidate subsequent road segment relative to the current road segment may be the ratio of the number of recording times of the candidate subsequent road segment to the total number of recording times of all candidate subsequent road segments. For example, as shown in FIG. 3, assuming that the current location where the first client is located is road segment a, the candidate subsequent road segments of the current location determined according to the recorded road segment information are b, d and f, and the numbers of recording times are 15, 5 and 80 respectively (corresponding transition probabilities are 0.15, 0.05 and 0.8 respectively). It should be noted that FIG. 3 only shows the numbers of recording times of the candidate subsequent road segments and does not show the transition probabilities of the candidate subsequent road segments relative to the current location.

In the embodiment of the present disclosure, the target subsequent road segment is determined from the plurality of candidate subsequent road segments of the current location of the first client according to the recorded road segment information, so as to obtain the road condition information of the target subsequent road segment of the current location in a targeted mode when responding to the road condition information request sent by the first client, thereby avoiding excessive useless interference road condition information caused by sending of the road condition information of surrounding roads to the first client, also avoiding system source waste caused by too much road condition information to be searched for, and solving the problem of low road condition information accuracy caused by sending of the road condition information of the road ahead to the first client, and accordingly, the technical effects of sending road condition information to the first client in a targeted mode and improving the accuracy of the road condition information sent to the first client are realized.

In the technical solution provided in step S208, after determining the target subsequent road segment of the current location of the first client, the server can obtain the road condition information of the target subsequent road segment in a targeted mode. The obtaining of the road condition information of the target subsequent road segment by the server may include, but is not limited to, judging whether the target subsequent road segment is congested; and calculating traffic cost in the case that the target subsequent road segment is congested, including congestion length, congestion time and the like. Specifically, the following method may be used to determine whether the target subsequent road segment is congested: the server may locate a client whose current location is located on the target subsequent road segment through location information sent by clients, and obtain the location change of the client within a preset time period; if the location of the client does not change significantly or the moving length is lower than a predetermined threshold within the preset time period, it can be determined that the current target subsequent road segment is congested, wherein the preset time period may be set or adjusted according to actual conditions, for example, 20 seconds, 1 minute and the like. The predetermined threshold may also be set or adjusted according to actual conditions, such as 5 meters, 10 meters and the like. The following method may be used to calculate the traffic cost in the case that the target subsequent road segment is congested: when it is detected that the location of the client does not change significantly or the moving length is less than the predetermined threshold within the preset time period, timing starts, timing ends when it is detected that the location of the client changes significantly or the moving length is not less than the predetermined threshold within the preset time period, and the accumulated duration can be used as the congestion time. The distance from the location of the client when timing starts to the location of the client when timing ends can be used as the congestion length. It should be noted that the above methods for determining whether the target subsequent road segment is congested and calculating the traffic cost in the case of congestion are only an alternative embodiment of the present disclosure. The present disclosure may also use other methods to determine whether the target subsequent road segment is congested and calculate the traffic cost in the case of congestion, which will not be described here by way of example. It should also be noted that when the target subsequent road segment is congested, the traffic cost is not limited to the congestion length and congestion time, but may include other contents, which will not be described here by way of example either.

After obtaining the road condition information of the target subsequent road segment, the server may transmit the road condition information of the target subsequent road segment to the first client by communicating with the first client, so as to achieve the purpose of responding to the road condition information request sent by the first client. It should be noted that when the server detects that the target subsequent road segment is congested, the road condition information of the target subsequent road segment transmitted to the first client may include congestion condition, traffic cost and the like; when the server detects that the target subsequent road segment is not congested, the road condition information of the target subsequent road segment transmitted to the first client may include a notification message such as "smooth road" and the like. After receiving the road condition information of the target subsequent road segment transmitted by the server, the first client may broadcast the road condition information in the form of voice broadcast so that the user can learn the road condition information of the target subsequent road segment in time, so as to improve the travel efficiency of the user.

Considering that the travel routes of the user have a certain rule based on time during actual application, for example, during the morning peak hours in working days, the travel route of the user is mainly the route from home to company. Therefore, the recorded road section information stored in the server of the embodiment of the present disclosure may also be used to indicate the recording time of the road section. Correspondingly, during determination of the target subsequent road segment from the plurality of candidate subsequent road segments of the current location of the first client according to the recorded road segment information, the embodiments of the present disclosure also consider the time factor.

For example, when the target subsequent road segment is determined by taking the number of recording times of the recorded road segments in the recorded road segment information as the reference factor, as an alternative embodiment, step S2062 of obtaining the number of recording times of each candidate subsequent road segment in the recorded road segment information comprises: Step S20622: Determine a time period to which a time at which the road condition information request is received belongs. Step S20624: Obtain the number of recording times of each candidate subsequent road segment within the time period. Correspondingly, step S2064 of determining the candidate subsequent road segment having the largest number of recording times as the target subsequent road segment comprises: Step S20642: Determine the candidate subsequent road segment having the largest number of recording times within the time period as the target subsequent road segment.

It should be noted that the server may record a receiving time when receiving the road condition information request sent by the first client, and determine the time period to which the receiving time belongs. It should be noted here that the server may divide time into a plurality of different time periods according to the actual situation, for example, morning peak hours in working days 07:00-10:00, dining time 11:30-12:30 and evening peak hours 17:00-20:00 and so on. For example, when the server receives the road condition information request sent by the first client at 08:00, the server may determine that the receiving time belongs to the morning peak hours 07:00-10:00. The recording time of each candidate subsequent road segment in the recorded road segment information stored in the server may vary. After determining the time period to which the time at which the road condition information request is received belongs, the server may obtain the number of recording times of each candidate subsequent road segment in the recorded road segment information within the time period, and take the candidate subsequent road segment having the largest number of recording times within the time period as the target subsequent road segment, so as to realize the purpose of determining the target subsequent road segment from the plurality of candidate subsequent road segments of the current location of the first client according to the recorded road segment information.

For example, as shown in FIG. 3, assuming that the current location of the first client is located on road segment a, the candidate subsequent road segments of the current location determined according to the recorded road segment information are b, d and f, the numbers of occurrences thereof are 15, 5 and 80 respectively, and the times of occurrences are 08:00, 05:00 and 09:15 respectively. Assuming that the server receives the road condition information request sent by the first client at 07:30 which belongs to the morning peak hours 07:00-10:00, the server first selects candidate subsequent road segments b and f with the recording time within the morning peak hours 07:00-10:00, and then the numbers of recording times of the candidate subsequent road segments b and f are compared to find that the number of recording times of the candidate subsequent road segment f is the largest, so the candidate subsequent road segment f is determined as the target subsequent road segment of the current location of the first client within the morning peak hours 07:00-10:00.

In the embodiment of the present disclosure, by determining the time period to which the time at which the road condition information request is received belongs, and determining the target subsequent road segment of the current location of the first client within the time period, the determined target subsequent road segment can be more in line with the travel rule of the user, thereby realizing the technical effect of improving the accuracy of the determined target subsequent road segment so as to improve the accuracy of the road condition information of the target subsequent road segment sent to the first client.

As an alternative embodiment, the recorded road segment information stored in the server may include first-type road segment information and/or second-type road segment information, wherein the first-type road segment information may be reported by the first client and may record the road segments reported by the first client and the attribute parameters of each road segment; the second-type road segment information may be reported by at least one second client and may record the road segments reported by the at least one second client and the attribute parameters of each road segment. It should be noted that "first" and "second" here are used only to distinguish different clients, and the order of the clients is not specifically limited. The types of the second client and the first client may be the same or different, which is not specifically limited in the embodiments of the present disclosure, for example, the second client may also be an application client. The second client may also be installed in a terminal device such as a mobile phone or a tablet computer, and may also have functions such as map navigation and road condition information broadcasting, such as a vehicle navigation application. The second client may also have communication functions including wired communication and wireless communication such as Bluetooth and WiFi. The second client can use the communication functions to communicate with the server for data exchange and information transfer, for example, reporting the second-type road segment information to the server.

It should be noted that, in the case that the recorded road segment information only includes the first-type road segment information, the embodiments of the present disclosure may determine the target subsequent road segment from the plurality of candidate subsequent road segments of the current location of the first client according to the first-type road segment information, for example, the method may specifically comprise: obtaining the number of recording times of each candidate subsequent road segment in the first-type road segment information; and determining a candidate subsequent road segment having the largest number of recording times as the target subsequent road segment.

In the case that the recorded road segment information only includes the second-type road segment information, the embodiments of the present disclosure may determine the target subsequent road segment from the plurality of candidate subsequent road segments of the current location of the first client according to the second-type road segment information, for example, the method may specifically comprise: obtaining the number of recording times of each candidate subsequent road segment in the second-type road segment information; and determining a candidate subsequent road segment having the largest number of recording times as the target subsequent road segment.

In the case that the recorded road segment information includes the first-type road segment information and the second-type road segment information, during the determination of the target subsequent road segment according to the recorded road segment information, the embodiments of the present disclosure may determine the target subsequent road segment according to the first-type road segment information first, for example, the method may specifically comprise: obtaining the number of recording times of each candidate subsequent road segment in the first-type road segment information; and determining a candidate subsequent road segment having the largest number of recording times as the target subsequent road segment. If the target subsequent road segment can not be determined according to the first-type road segment information, for example, the current location of the first client is not recorded in the first-type road segment information, or the target subsequent road segment determined according to the first-type road segment information does not meet the predetermined requirement, for example, the first-type road segment information is little, the accuracy of the target subsequent road segment determined by using the first-type road segment information is low, the embodiments of the present disclosure may determine the target subsequent road segment according to the second-type road segment information.

It should be noted that in the case that the recorded road segment information includes the first-type road segment information and the second-type road segment information, in principle, the target subsequent road segment may be determined according to the first-type road segment information or the second-type road segment information. However, in order to make the determined target subsequent road segment more consistent with user requirements of the first client, the embodiments of the present disclosure preferably set the priority of the determination of the target subsequent road segment according to the first-type road segment information to be higher than the priority of the determination of the target subsequent road segment according to the second-type road segment information, that is, the target subsequent road segment is determined according to the first-type road segment information first, in this way, the determined target subsequent road segment can be more consistent with user requirements of the first client, thereby improving the accuracy of the determined target subsequent road segment, and the technical effect of improving the accuracy of the road condition information of the target subsequent road segment sent to the first client is realized.

It should also be noted that, for the case when the recorded road segment information includes the first-type road segment information and the second-type road segment information, the situation that the target subsequent road segment can not be determined according to the first-type road segment information or the target subsequent road segment determined according to the first-type road segment information does not meet the predetermined requirement may be specified by the following alternative embodiments:

As an alternative embodiment, in the case when the recorded road segment information includes the first-type road segment information and the second-type road segment information, if the number of recording times of each candidate subsequent road segment in the first-type road segment information is less than a predetermined threshold, the target subsequent road segment can be determined according to the second-type road segment information from the plurality of candidate subsequent road segments, for example, the method may specifically comprises: obtaining the number of recording times of each candidate subsequent road segment in the second-type road segment information; and determining a candidate subsequent road segment having the largest number of recording times as the target subsequent road segment. It should be noted that the predetermined threshold may be set or adjusted according to actual situations, which is not specifically limited in the embodiments of the present disclosure, for example, the predetermined threshold may be 10, 15 and the like.

Figure 4:
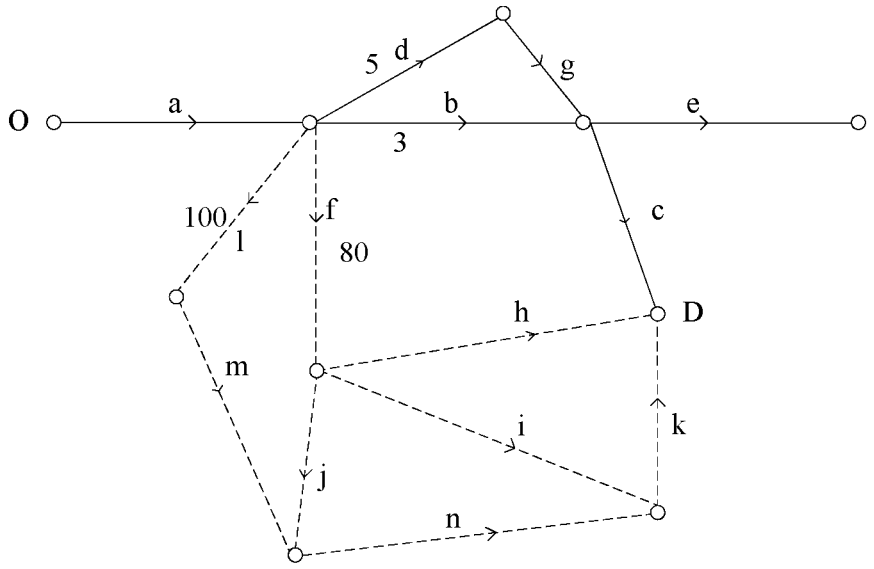
FIG. 4 is a schematic diagram of another alternative recorded road segment in recorded road segment information according to the embodiments of the present disclosure.

For example, as shown in FIG. 4, assuming that the current location of the first client is located at road segment a, the road segments a, b, c, d, e, and g recorded in the first-type road segment information are represented by solid lines, and the candidate subsequent road segments of the current location are b and d. The road segments a, f, h, i, j, k, l, m and n recorded in the second-type road segment information are represented by dotted lines, and the candidate subsequent road segments of the current location are f and l. For the above situation, in principle, the embodiments of the present disclosure may select the target subsequent road segment from the candidate subsequent road segments b and d according to the first-type road segment information. However, the numbers of recording times of the road segments b and d in the first-type road segment information are small, 3 and 5 respectively. Assuming that the predetermined threshold is 10, it is found through comparison that the number of recording times of each candidate subsequent road segment in the first-type road segment information is less than the predetermined threshold, then the target subsequent road segment is determined from the candidate subsequent road segments f and l according to the second-type road segment information, as shown in FIG. 4, the numbers of occurrences of the candidate subsequent road segments f and l in the second-type road segment information are 80 and 100 respectively, and by means of the method for determining the target subsequent road segment from the plurality of candidate subsequent road segments according to the second-type road segment information, the road segment l having the largest number of recording times is determined as the target subsequent road segment.

In the embodiments of the present disclosure, when the target subsequent road segment is determined from the plurality of candidate subsequent road segments according to the first-type road segment information in the above-mentioned case, if the number of recording times of each candidate subsequent road segment in the first-type road segment information is less than the predetermined threshold, it indicates that the first-type road segment information is little, and if the first-type road segment information is used as a basis for determining the target subsequent road segment, deviations may occur and the determined target subsequent road segment is not accurate enough. At this time, the embodiments of the present disclosure may determine the target subsequent road segment from the plurality of candidate subsequent road segments according to the second-type road segment information, and a candidate subsequent road segment having the largest number of recording times in the second-type road segment information is determined as the target subsequent road segment, so as to ensure that the determined target subsequent road segment is more accurate, thereby achieving the effect of improving the accuracy of the road condition information of the target subsequent road segment transmitted to the first client.

As another alternative embodiment, in the case when the recorded road segment information includes the first-type road segment information and the second-type road segment information, if there are a plurality of candidate subsequent road segments having the largest number of recording times in the first-type road segment information, besides determining a candidate subsequent road segment having the shortest length as the target subsequent road segment according to road segment lengths recorded in the first-type road segment information, the embodiments of the present disclosure may also determine the target subsequent road segment from the plurality of candidate subsequent road segments according to the second-type road segment information, for example, the method may specifically comprise: obtaining the number of recording times of each candidate subsequent road segment in the second-type road segment information; and determining a candidate subsequent road segment having the largest number of recording times as the target subsequent road segment.

Figure 5:
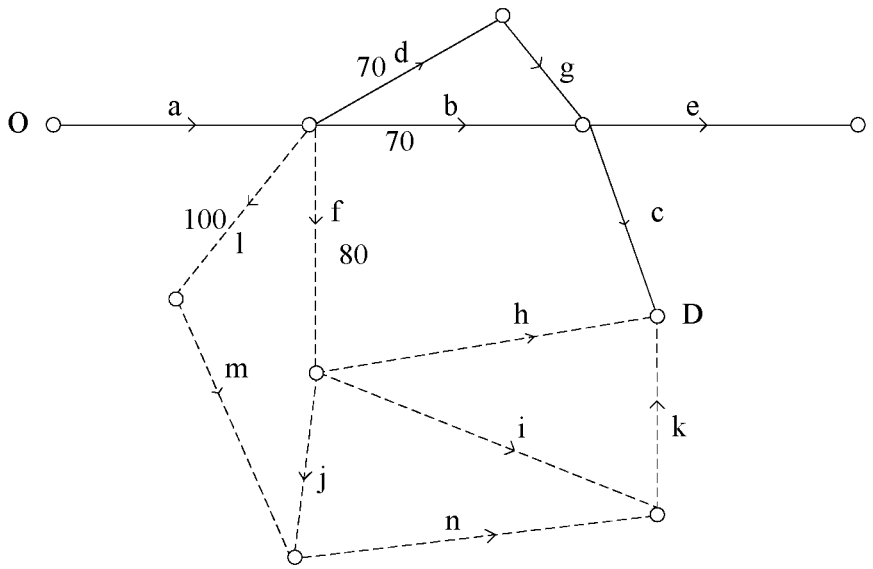
FIG. 5 is a schematic diagram of yet another alternative recorded road segment in recorded road segment information according to the embodiments of the present disclosure.

For example, as shown in FIG. 5, assuming that the current location of the first client is located at road segment a, the road segments a, b, c, d, e, and g recorded in the first-type road segment information are represented by solid lines, and the candidate subsequent road segments of the current location are b and d. The road segments a, f, h, i, j, k, l, m and n recorded in the second-type road segment information are represented by dotted lines, and the candidate subsequent road segments of the current location are f and l. For the above situation, in principle, the embodiments of the present disclosure may select the target subsequent road segment from the candidate subsequent road segments b and d according to the first-type road segment information, however, the numbers of recording times of the road segments b and d in the first-type road segment information are the same, both are 70 (it should be noted that FIG. 5 only shows the situation when the first-type road segment information includes two candidate subsequent road segments, and the situation that the first-type road segment information includes more than two candidate subsequent road segments and there are two or more candidate subsequent road segments having the largest number of recording times in the candidate subsequent road segments is also applicable to this alternative embodiment). In this case, the embodiments of the present disclosure may determine a candidate subsequent road segment having the largest number of recording times in the candidate subsequent road segments f and l as the target subsequent road segment according to the second-type road segment information, as shown in FIG. 5, the numbers of recording times of the candidate subsequent road segments f and l in the second-type road segment information are 80 and 100 respectively, and then the road segment l having the largest number of recording times is determined as the target subsequent road segment.

In the embodiments of the present disclosure, when the target subsequent road segment is determined from the plurality of candidate subsequent road segments according to the first-type road segment information in the above-mentioned case, if there are a plurality of candidate subsequent road segments having the largest number of occurrences in the first-type road segment information, it indicates that an optimal choice can not be obtained according to the first-type road segment information, at this time, the embodiments of the present disclosure may select a candidate subsequent road segment having the largest number of recording times from the plurality of candidate subsequent road segments as the target subsequent road segment according to the second-type road segment information, so as to ensure that the determined target subsequent road segment is more accurate, thereby achieving the effect of improving the accuracy of the road condition information of the target subsequent road segment transmitted to the first client.

It should be noted that, in the foregoing cases, during determination of a target subsequent road segment from the plurality of candidate subsequent road segments according to the recorded road segment information, the number of recording times of each candidate subsequent road segment in the recorded road segment information within a time period to which a time at which a road condition information request is received belongs can be obtained, a candidate subsequent road segment having the largest number of recording times within the time period is determined as the target subsequent road segment, so as to ensure the accuracy of the determined target subsequent road segment.

The following describes in detail the terminal executing the road condition information transmission method according to the embodiments of the present disclosure.

Figure 6:
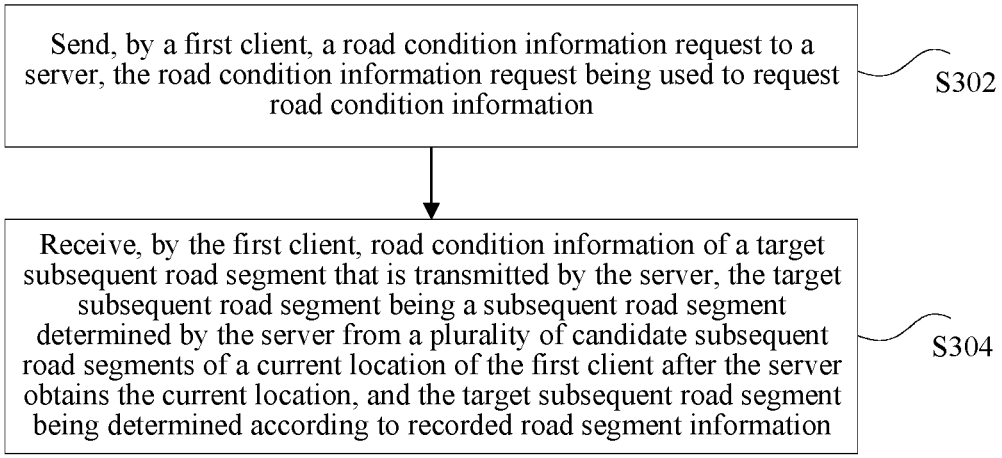
FIG. 6 is a flowchart of an alternative road condition information transmission method according to the embodiments of the present disclosure.

FIG. 6 is a flowchart of an alternative road condition information transmission method according to the embodiments of the present disclosure. As shown in FIG. 6, the method may comprise the following steps:

Step S302: Send, by a first client, a road condition information request to a server, the road condition information request being used to request road condition information.

Step S304: Receive, by the first client, road condition information of a target subsequent road segment that is transmitted by the server, the target subsequent road segment being a subsequent road segment determined by the server from a plurality of candidate subsequent road segments of a current location of the first client after the server obtains the current location, and the target subsequent road segment being determined according to recorded road segment information.

It should be noted that the above steps S302-S304 may be executed by the terminal 104 shown in FIG. 1, or may be executed by a client (for example, the first client here) installed thereon. When the terminal executes the foregoing road condition information transmission method, it mainly involves sending a road condition information request to the server and receiving the road condition information of a target subsequent road segment returned by the server, and the determination of the target subsequent road segment and the obtaining of the road condition information of the target subsequent road segment are mainly performed by the server. The execution process involved in the road condition information transmission method has already been described in detail in the road condition information transmission method executed by the server described above in the present disclosure, and will not be described here.

A road condition information obtaining method provided in the embodiments of the present disclosure may be executed by a terminal. The road condition information obtaining method in the embodiments of the present disclosure will be described below.

Figure 7:
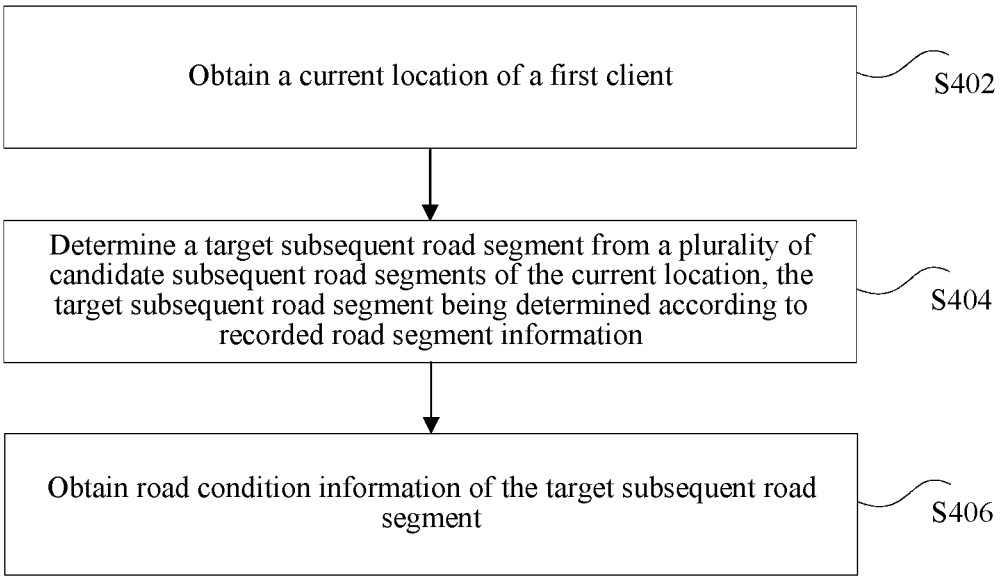
FIG. 7 is a flowchart of an alternative road condition information obtaining method according to the embodiments of the present disclosure.

FIG. 7 is a flowchart of an alternative road condition information obtaining method according to the embodiments of the present disclosure. As shown in FIG. 7, the method may comprise the following steps:

Step S402: Obtain a current location of a first client.

Step S404: Determine a target subsequent road segment from a plurality of candidate subsequent road segments of the current location, the target subsequent road segment being determined according to recorded road segment information.

Step S406: Obtain road condition information of the target subsequent road segment.

By means of steps S402-S406, by determining the target subsequent road segment from the plurality of candidate subsequent road segments according to the recorded road segment information, and obtaining the road condition information of the target subsequent road segment, the purpose of obtaining the road condition information in a targeted mode is realized, accordingly the technical problem that in the related technology, the server can only send the road condition information of the road ahead to the client, leading to low accuracy of the road condition information sent to the client is solved, and the technical effect of improving the accuracy of the road condition information sent to the client is realized.

In the technical solution provided in step S402, the embodiments of the present disclosure do not specifically limit the type of the first client, for example, the first client may be an application client. The first client may be installed in a terminal device. The embodiments of the present disclosure do not specifically limit the type of the terminal device where the first client is located either, for example, the terminal device may be a mobile phone, a tablet computer and the like. The first client may have functions such as map navigation and road condition information broadcasting, such as a vehicle navigation application. A GPS positioning module may be disposed in the terminal, and the current location of the first client may be obtained by using the GPS positioning module. It should be noted that the GPS positioning module may be located in the terminal device where the first client is located, or may be embedded in the first client as a functional program code, and the terminal may obtain the current location of the first client by receiving coordinate information reported by the GPS positioning module in real time. It should be noted that the embodiments of the present disclosure do not specifically limit the way of obtaining the current location of the first client, and the current location of the first client may also be obtained through other ways, which will not be described here by way of example.

In the technical solution provided in step S404, a large amount of recorded road segment information may be pre-stored in the terminal, and a plurality of road segments may be recorded in the recorded road segment information. These road segments may be road segments already completed by the first client, or road segments completed by other clients, or a set of road segments completed by the first client and other clients. The road segments recorded in the recorded road segment information may be marked by identifiers. For example, as shown in FIG. 3, ten road segments are recorded in the recorded road segment information, and the road segments are represented by a, b, c, d, e, f, h, i, j and k respectively. The attribute parameters of each road segment may be recorded in the recorded road segment information, and the attribute parameters of each road segment may include, but are not limited to, the length of the road segment, the number of recording times of the road segment and the like. For example, as shown in FIG. 3, the number of recording times of the road segment b is 15, the length is 200 meters, the number of recording times of the road segment d is 5, the length is 150 meters, the number of recording times of the road segment f is 80, and the length is 100 meters. It should be noted here that the number of recording times and length of other road segments are not shown in FIG. 3.

After obtaining the current location of the first client, the terminal may determine a plurality of candidate subsequent road segments of the current location of the first client according to the recorded road segment information. It should be noted that the embodiments of the present disclosure provide the following two alternative methods for determining the plurality of candidate subsequent road segments of the current location of the first client, specifically:

The first alternative determining method comprises: obtaining destination information after obtaining the current location of the first client, and determining the plurality of candidate subsequent road segments of the current location of the first client according to the current location of the first client and the obtained destination information. It should be noted that the destination information may be location information preset by the user in the first client. After a destination is determined, all passable routes from the current location of the first client to the destination may be obtained according to the recorded road segment information, and then the plurality of candidate subsequent road segments of the current location of the first client can be determined based on these passable routes. For example, as shown in FIG. 3, assuming that 0 is a start point, D is an end point and the current location of the first client is located on road segment a, all passable routes from the current location of the first client to the end point D are a-b-c, a-f-h and a-f-i-k, and according to these passable routes, it can be determined that the candidate subsequent road segments of the current location of the first client are road segment b and road segment f. It should be noted that the foregoing method for determining the plurality of candidate subsequent road segments of the current location of the first client is more applicable to the case when a destination is known in advance.

The second alternative determining method comprises: obtaining a driving direction of the first client after obtaining the current location of the first client, and determining the plurality of candidate subsequent road segments of the current location of the first client according to the current location and driving direction of the first client. It should be noted that the driving direction of the first client may be obtained by obtaining the location information at the first moment and the second moment, and taking the direction from the location where the first client is located at the first moment to the location where the first client is located at the second moment as the driving direction of the first client. After determining the driving direction of the first client, a plurality of passable road segments indicated by the driving direction of the first client may be determined as the plurality of candidate subsequent road segments of the current location of the first client. For example, as shown in FIG. 3, assuming that the current location of the first client is located on road segment a and the driving direction is as indicated by the arrow in the figure, it can be determined that the passable road segments indicated by the driving direction include road segment b, road segment d, and road segment f, and the plurality of candidate subsequent road segments of the current location of the first client are road segment b, road segment d, and road segment f. It should be noted that the foregoing method for determining the plurality of candidate subsequent road segments of the current location of the first client is more applicable to a case when the destination is unknown.

It should be noted that the embodiments of the present disclosure may also comprise other methods for determining the plurality of candidate subsequent road segments of the current location of the first client, which will not be described here by way of example. In the embodiments of the present disclosure, a method for determining the plurality of candidate subsequent road segments of the current location of the first client may be selected according to actual requirements.

After the plurality of candidate subsequent road segments of the current location of the first client are determined, a target subsequent road segment may be determined from the plurality of candidate subsequent road segments according to the attribute parameters of each candidate subsequent road segment in the recorded road segment information, wherein the target subsequent road segment is the next driving road segment of the first client, and the attribute parameters of each road segment that can be recorded in the recorded road segment information may include the length of the road segment, the number of recording times of the road segment and the like. The length of the road segment can affect the driving time and fuel consumption of the first client, and the user tends to select a road segment with a shorter distance during actual driving. The number of recording times of the road segment can be used to indicate the probability that the user selects the road segment, that is, the larger the number of recording times of the road segment is, the higher the probability that the user will select the road segment during actual driving is.

As an alternative embodiment, the determination of the target subsequent road segment according to recorded road segment information may comprise: obtaining the length of each candidate subsequent road segment in the recorded road segment information; and determining a candidate subsequent road segment having the shortest length as the target subsequent road segment. For example, as shown in FIG. 3, assuming that the current location of the first client is located on road segment a, the plurality of candidate subsequent road segments of the current location of the first client determined based on the recorded road segment information are road segment b, road segment d, and road segment f, the length of the road segment b is 200 meters, the length of the road segment d is 150 meters, the length of the road segment f is 100 meters, and then it can be determined that the target subsequent road segment is the road segment f having the shortest length by referring to the attribute parameter, road segment length. The target subsequent road segment determined by the alternative embodiment has the shortest length, so that driving time can be effectively shortened and fuel consumption can be reduced.

As another alternative embodiment, the determination of the target subsequent road segment according to the recorded road segment information may comprise: obtaining the number of recording times of each candidate subsequent road segment in the recorded road segment information; and determining a candidate subsequent road segment having the largest number of recording times as the target subsequent road segment. For example, as shown in FIG. 3, assuming that the current location of the first client is located on road segment a, the plurality of candidate subsequent road segments of the current location of the first client determined based on the recorded road segment information are road segment b, road segment d, and road segment f, the number of recording times of the road segment b is 15, the number of recording times of the road segment d is 5, the number of recording times of the road segment f is 80, and then it can be determined that the target subsequent road segment is the road segment f having the largest number of recording times by referring to the attribute parameter, the number of recording times. The target subsequent road segment determined by the alternative embodiment has the largest number of recording times, which is more in line with the travel habits and travel requirements of the user.

It should be noted that in the actual application scenario, the target subsequent road segment may be determined by any one of the foregoing two alternative embodiments according to actual requirements. However, considering that there may be a plurality of target subsequent road segments determined by using a single attribute parameter, for example, it is determined that a plurality of candidate subsequent road segments having the shortest length exist in the plurality of candidate subsequent subsequent road segments of the current location of the first client according to the attribute parameter, road segment length, at this time, in the embodiment of the present disclosure, the numbers of recording times of the plurality of candidate subsequent road segments having the shortest length can be obtained from the recorded road segment information, and a candidate subsequent road segment having the largest number of recording times is selected from the plurality of candidate subsequent road segments having the shortest length as the target subsequent road segment according to the number of recording times of road segments. It should be noted that if there are a plurality of candidate subsequent road segments having the largest number of recording times in the plurality of candidate subsequent road segments having the shortest length, any one of the candidate subsequent road segments can be randomly selected as the target subsequent road segment. For another example, it is determined that a plurality of candidate subsequent road segments having the the largest number of recording times exist in the plurality of candidate subsequent subsequent road segments of the current location of the first client according to the attribute parameter, the number of recording times, at this time, in the embodiment of the present disclosure, the length of each of the plurality of candidate subsequent road segments having the largest number of recording times can be obtained from the recorded road segment information, and a candidate subsequent road segment having the shortest length is selected from the plurality of candidate subsequent road segments having the largest number of recording times as the target subsequent road segment according to road segment length. It should be noted that if there are a plurality of candidate subsequent road segments having the shortest length in the plurality of candidate subsequent road segments having the largest number of recording times, any one of the candidate subsequent road segments can be randomly selected as the target subsequent road segment. The target subsequent road segment determined by the above determining method in the embodiment of the present disclosure has higher accuracy and is more in line with the actual needs of the user. Road condition information of the target subsequent road segment determined by the above determining method can be transmitted to the user more accurately, and is more in line with the actual needs of the user.

It should also be noted that the number of recording times of each candidate subsequent road segment in the recorded road segment information may also be expressed in the form of transition probability, and the transition probability of each candidate subsequent road segment relative to the current road segment may be the ratio of the number of recording times of the candidate subsequent road segment to the total number of recording times of all candidate subsequent road segments. For example, as shown in FIG. 3, assuming that the current location where the first client is located is road segment a, the candidate subsequent road segments of the current location determined according to the recorded road segment information are b, d and f, and the numbers of recording times are 15, 5 and 80 respectively (corresponding transition probabilities are 0.15, 0.05 and 0.8 respectively). It should be noted that FIG. 3 only shows the numbers of recording times of the candidate subsequent road segments and does not show the transition probabilities of the candidate subsequent road segments relative to the current location.

In the embodiments of the present disclosure, the target subsequent road segment is determined from the plurality of candidate subsequent road segments of the current location of the first client according to the recorded road segment information, so as to obtain the road condition information of the target subsequent road segment of the current location in a targeted mode, thereby avoiding excessive useless interference road condition information caused by the obtained road condition information of surrounding roads of the first client, also avoiding system source waste caused by too much road condition information to be searched for, and solving the problem of low road condition information accuracy caused by obtaining of the road condition information of the road ahead of the first client, and accordingly, the technical effects of obtaining the road condition information of the first client in a targeted mode and improving the accuracy of the obtained road condition information of the first client are realized.

In the technical solution provided in step S406, after the target subsequent road segment of the current location of the first client is determined, the road condition information of the target subsequent road segment can be obtained in a targeted mode. The obtaining of the road condition information of the target subsequent road segment may include, but is not limited to, judging whether the target subsequent road segment is congested; and calculating traffic cost in the case that the target subsequent road segment is congested, including congestion length, congestion time and the like. Specifically, the following method may be used to determine whether the target subsequent road segment is congested: a client whose current location is located on the target subsequent road segment is positioned through location information sent by clients, and the location change of the client within a preset time period is obtained; if the location of the client does not change significantly or the moving length is lower than a predetermined threshold within the preset time period, it can be determined that the current target subsequent road segment is congested, wherein the preset time period may be set or adjusted according to actual conditions, for example, 20 seconds, 1 minute and the like. The predetermined threshold may also be set or adjusted according to actual conditions, such as 5 meters, 10 meters and the like. The following method may be used to calculate the traffic cost in the case that the target subsequent road segment is congested: when it is detected that the location of the client does not change significantly or the moving length is less than the predetermined threshold within the preset time period, timing starts, timing ends when it is detected that the location of the client changes significantly or the moving length is not less than the predetermined threshold within the preset time period, and the accumulated duration can be used as the congestion time. The distance from the location of the client when timing starts to the location of the client when timing ends can be used as the congestion length. It should be noted that the above methods for determining whether the target subsequent road segment is congested and calculating the traffic cost in the case of congestion are only an alternative embodiment of the present disclosure. The present disclosure may also use other methods to determine whether the target subsequent road segment is congested and calculate the traffic cost in the case of congestion, which will not be described here by way of example. It should also be noted that when the target subsequent road segment is congested, the traffic cost is not limited to the congestion length and congestion time, but may include other contents, which will not be described here by way of example either.

It should be noted that when it is detected that the target subsequent road segment is congested, the road condition information of the target subsequent road segment of the first client may include congestion condition, traffic cost and the like; when it is detected that the target subsequent road segment is not congested, the road condition information of the target subsequent road segment of the first client may include a notification message such as "smooth road" and the like. After receiving the road condition information of the target subsequent road segment of the first client, the road condition information may be broadcast in the form of voice broadcast so that the user can learn the road condition information of the target subsequent road segment in time, so as to improve the travel efficiency of the user.

Considering that the travel routes of the user have a certain rule based on time during actual application, for example, during the morning peak hours in working days, the travel route of the user is mainly the route from home to company. Therefore, the recorded road segment information stored in the terminal of the embodiment of the present disclosure may also be used to indicate the recording time of the road segment. Correspondingly, during determination of the target subsequent road segment from the plurality of candidate subsequent road segments of the current location of the first client according to the recorded road segment information, the embodiments of the present disclosure also consider the time factor.

For example, when the target subsequent road segment is determined by taking the number of recording times of the recorded road segments in the recorded road segment information as the reference factor, as an alternative embodiment, the obtaining of the number of recording times of each candidate subsequent road segment in the recorded road segment information comprises: determining a time period to which the time at which the road condition information request is received belongs; and obtaining the number of recording times of each candidate subsequent road segment within the time period. Correspondingly, the determination of the candidate subsequent road segment having the largest number of recording times as the target subsequent road segment comprises: determining the candidate subsequent road segment having the largest number of recording times within the time period as the target subsequent road segment.

It should be noted that the current time may be recorded when the current location of the first client is obtained, and the time period to which the time belongs is determined. It should be noted here that the terminal may divide time into a plurality of different time periods according to the actual situation, for example, morning peak hours in working days 07:00-10:00, dining time 11:30-12:30 and evening peak hours 17:00-20:00 and so on. For example, the current location of the first client is obtained at 08:00, and it can be determined that the time belongs to the morning peak hours 07:00-10:00. The recording time of each candidate subsequent road segment in the recorded road segment information stored in the terminal may vary. After determining the time period to which the time at which the current location of the first client is obtained belongs, the number of recording times of each candidate subsequent road segment in the recorded road segment information within the time period may be obtained, and the candidate subsequent road segment having the largest number of recording times within the time period may be determined as the target subsequent road segment, so as to realize the purpose of determining the target subsequent road segment from the plurality of candidate subsequent road segments of the current location of the first client according to the recorded road segment information.

For example, as shown in FIG. 3, assuming that the current location of the first client is located on road segment a, the candidate subsequent road segments of the current location determined according to the recorded road segment information are b, d and f, the numbers of occurrences thereof are 15, 5 and 80 respectively, and the times of occurrences are 08:00, 05:00 and 09:15 respectively. Assuming that the current location of the first client is obtained at 07:30 which belongs to the morning peak hours 07:00-10:00, candidate subsequent road segments b and f with the recording time within the morning peak hours 07:00-10:00 are firstly selected, and then the numbers of recording times of the candidate subsequent road segments b and f are compared to find that the number of recording times of the candidate subsequent road segment f is the largest, so the candidate subsequent road segment f is determined as the target subsequent road segment of the current location of the first client within the morning peak hours 07:00-10:00.

In the embodiment of the present disclosure, by determining the time period to which the time at which the current location of the first client is obtained belongs, and determining the target subsequent road segment of the current location of the first client within the time period, the determined target subsequent road segment can be more in line with the travel rule of the user, thereby realizing the technical effect of improving the accuracy of the determined target subsequent road segment so as to improve the accuracy of the road condition information of the target subsequent road segment sent to the first client.

As an alternative embodiment, the recorded road segment information stored in the terminal may include first-type road segment information and/or second-type road segment information, wherein the first-type road segment information may be reported by the first client and may record the road segments reported by the first client and the attribute parameters of each road segment; the second-type road segment information may be reported by at least one second client and may record the road segments reported by the at least one second client and the attribute parameters of each road segment. It should be noted that "first" and "second" here are used only to distinguish different clients, and the order of the clients is not specifically limited. The types of the second client and the first client may be the same or different, which is not specifically limited in the embodiments of the present disclosure, for example, the second client may also be an application client. The second client may also be installed in a terminal device such as a mobile phone or a tablet computer, and may also have functions such as map navigation and road condition information broadcasting, such as a vehicle navigation application.

It should be noted that, in the case that the recorded road segment information only includes the first-type road segment information, the embodiments of the present disclosure may determine the target subsequent road segment from the plurality of candidate subsequent road segments of the current location of the first client according to the first-type road segment information, for example, the method may specifically comprise: obtaining the number of recording times of each candidate subsequent road segment in the first-type road segment information; and determining a candidate subsequent road segment having the largest number of recording times as the target subsequent road segment.

In the case that the recorded road segment information only includes the second-type road segment information, the embodiments of the present disclosure may determine the target subsequent road segment from the plurality of candidate subsequent road segments of the current location of the first client according to the second-type road segment information, for example, the method may specifically comprise: obtaining the number of recording times of each candidate subsequent road segment in the second-type road segment information; and determining a candidate subsequent road segment having the largest number of recording times as the target subsequent road segment.

In the case that the recorded road segment information includes the first-type road segment information and the second-type road segment information, during the determination of the target subsequent road segment according to the recorded road segment information, the embodiments of the present disclosure may determine the target subsequent road segment according to the first-type road segment information first, for example, the method may specifically comprise: obtaining the number of recording times of each candidate subsequent road segment in the first-type road segment information; and determining a candidate subsequent road segment having the largest number of recording times as the target subsequent road segment. If the target subsequent road segment can not be determined according to the first-type road segment information, for example, the current location of the first client is not recorded in the first-type road segment information, or the target subsequent road segment determined according to the first-type road segment information does not meet the predetermined requirement, for example, the first-type road segment information is little, the accuracy of the target subsequent road segment determined by using the first-type road segment information is low, the embodiments of the present disclosure may determine the target subsequent road segment according to the second-type road segment information.

It should be noted that in the case that the recorded road segment information includes the first-type road segment information and the second-type road segment information, in principle, the target subsequent road segment may be determined according to the first-type road segment information or the second-type road segment information. However, in order to make the determined target subsequent road segment more consistent with user requirements of the first client, the embodiments of the present disclosure preferably set the priority of the determination of the target subsequent road segment according to the first-type road segment information to be higher than the priority of the determination of the target subsequent road segment according to the second-type road segment information, that is, the target subsequent road segment is determined according to the first-type road segment information first, in this way, the determined target subsequent road segment can be more consistent with user requirements of the first client, thereby improving the accuracy of the determined target subsequent road segment, and the technical effect of improving the accuracy of the road condition information of the target subsequent road segment sent to the first client is realized.

It should also be noted that, for the case when the recorded road segment information includes the first-type road segment information and the second-type road segment information, the situation that the target subsequent road segment can not be determined according to the first-type road segment information or the target subsequent road segment determined according to the first-type road segment information does not meet the predetermined requirement may be specified by the following alternative embodiments:

As an alternative embodiment, in the case when the recorded road segment information includes the first-type road segment information and the second-type road segment information, if the number of recording times of each candidate subsequent road segment in the first-type road segment information is less than a predetermined threshold, the target subsequent road segment can be determined according to the second-type road segment information from the plurality of candidate subsequent road segments, for example, the method may specifically comprises: obtaining the number of recording times of each candidate subsequent road segment in the second-type road segment information; and determining a candidate subsequent road segment having the largest number of recording times as the target subsequent road segment. It should be noted that the predetermined threshold may be set or adjusted according to actual situations, which is not specifically limited in the embodiments of the present disclosure, for example, the predetermined threshold may be 10, 15 and the like.

For example, as shown in FIG. 4, assuming that the current location of the first client is located at road segment a, the road segments a, b, c, d, e, and g recorded in the first-type road segment information are represented by solid lines, and the candidate subsequent road segments of the current location are b and d. The road segments a, f, h, i, j, k, l, m and n recorded in the second-type road segment information are represented by dotted lines, and the candidate subsequent road segments of the current location are f and l. For the above situation, in principle, the embodiments of the present disclosure may select the target subsequent road segment from the candidate subsequent road segments b and d according to the first-type road segment information. However, the numbers of recording times of the road segments b and d in the first-type road segment information are small, 3 and 5 respectively. Assuming that the predetermined threshold is 10, it is found through comparison that the number of recording times of each candidate subsequent road segment in the first-type road segment information is less than the predetermined threshold, then the target subsequent road segment is determined from the candidate subsequent road segments f and l according to the second-type road segment information, as shown in FIG. 4, the numbers of occurrences of the candidate subsequent road segments f and l in the second-type road segment information are 80 and 100 respectively, and by means of the method for determining the target subsequent road segment from the plurality of candidate subsequent road segments according to the second-type road segment information, the road segment l having the largest number of recording times is determined as the target subsequent road segment.

In the embodiments of the present disclosure, when the target subsequent road segment is determined from the plurality of candidate subsequent road segments according to the first-type road segment information in the above-mentioned case, if the number of recording times of each candidate subsequent road segment in the first-type road segment information is less than the predetermined threshold, it indicates that the first-type road segment information is little, and if the first-type road segment information is used as a basis for determining the target subsequent road segment, deviations may occur and the determined target subsequent road segment is not accurate enough. At this time, the embodiments of the present disclosure may determine the target subsequent road segment from the plurality of candidate subsequent road segments according to the second-type road segment information, and a candidate subsequent road segment having the largest number of recording times in the second-type road segment information is determined as the target subsequent road segment, so as to ensure that the determined target subsequent road segment is more accurate, thereby achieving the effect of improving the accuracy of the road condition information of the target subsequent road segment transmitted to the first client.

As another alternative embodiment, in the case when the recorded road segment information includes the first-type road segment information and the second-type road segment information, if there are a plurality of candidate subsequent road segments having the largest number of recording times in the first-type road segment information, besides determining a candidate subsequent road segment having the shortest length as the target subsequent road segment according to road segment lengths recorded in the first-type road segment information, the embodiments of the present disclosure may also determine the target subsequent road segment from the plurality of candidate subsequent road segments according to the second-type road segment information, for example, the method may specifically comprise: obtaining the number of recording times of each candidate subsequent road segment in the second-type road segment information; and determining a candidate subsequent road segment having the largest number of recording times as the target subsequent road segment.

For example, as shown in FIG. 5, assuming that the current location of the first client is located at road segment a, the road segments a, b, c, d, e, and g recorded in the first-type road segment information are represented by solid lines, and the candidate subsequent road segments of the current location are b and d. The road segments a, f, h, i, j, k, l, m and n recorded in the second-type road segment information are represented by dotted lines, and the candidate subsequent road segments of the current location are f and l. For the above situation, in principle, the embodiments of the present disclosure may select the target subsequent road segment from the candidate subsequent road segments b and d according to the first-type road segment information, however, the numbers of recording times of the road segments b and d in the first-type road segment information are the same, both are 70 (it should be noted that FIG. 5 only shows the situation when the first-type road segment information includes two candidate subsequent road segments, and the situation that the first-type road segment information includes more than two candidate subsequent road segments and there are two or more candidate subsequent road segments having the largest number of recording times in the candidate subsequent road segments is also applicable to this alternative embodiment). In this case, the embodiments of the present disclosure may determine a candidate subsequent road segment having the largest number of recording times in the candidate subsequent road segments f and l as the target subsequent road segment according to the second-type road segment information, as shown in FIG. 5, the numbers of recording times of the candidate subsequent road segments f and l in the second-type road segment information are 80 and 100 respectively, and then the road segment l having the largest number of recording times is determined as the target subsequent road segment.

In the embodiments of the present disclosure, when the target subsequent road segment is determined from the plurality of candidate subsequent road segments according to the first-type road segment information in the above-mentioned case, if there are a plurality of candidate subsequent road segments having the largest number of occurrences in the first-type road segment information, it indicates that an optimal choice can not be obtained according to the first-type road segment information, at this time, the embodiments of the present disclosure may select a candidate subsequent road segment having the largest number of recording times from the plurality of candidate subsequent road segments as the target subsequent road segment according to the second-type road segment information, so as to ensure that the determined target subsequent road segment is more accurate, thereby achieving the effect of improving the accuracy of the road condition information of the target subsequent road segment transmitted to the first client.

It should be noted that, in the foregoing cases, during determination of a target subsequent road segment from the plurality of candidate subsequent road segments according to the recorded road segment information, the number of recording times of each candidate subsequent road segment in the recorded road segment information within a time period to which a time at which a road condition information request is received belongs can be obtained, a candidate subsequent road segment having the largest number of recording times within the time period is determined as the target subsequent road segment, so as to ensure the accuracy of the determined target subsequent road segment.

Figure 8:
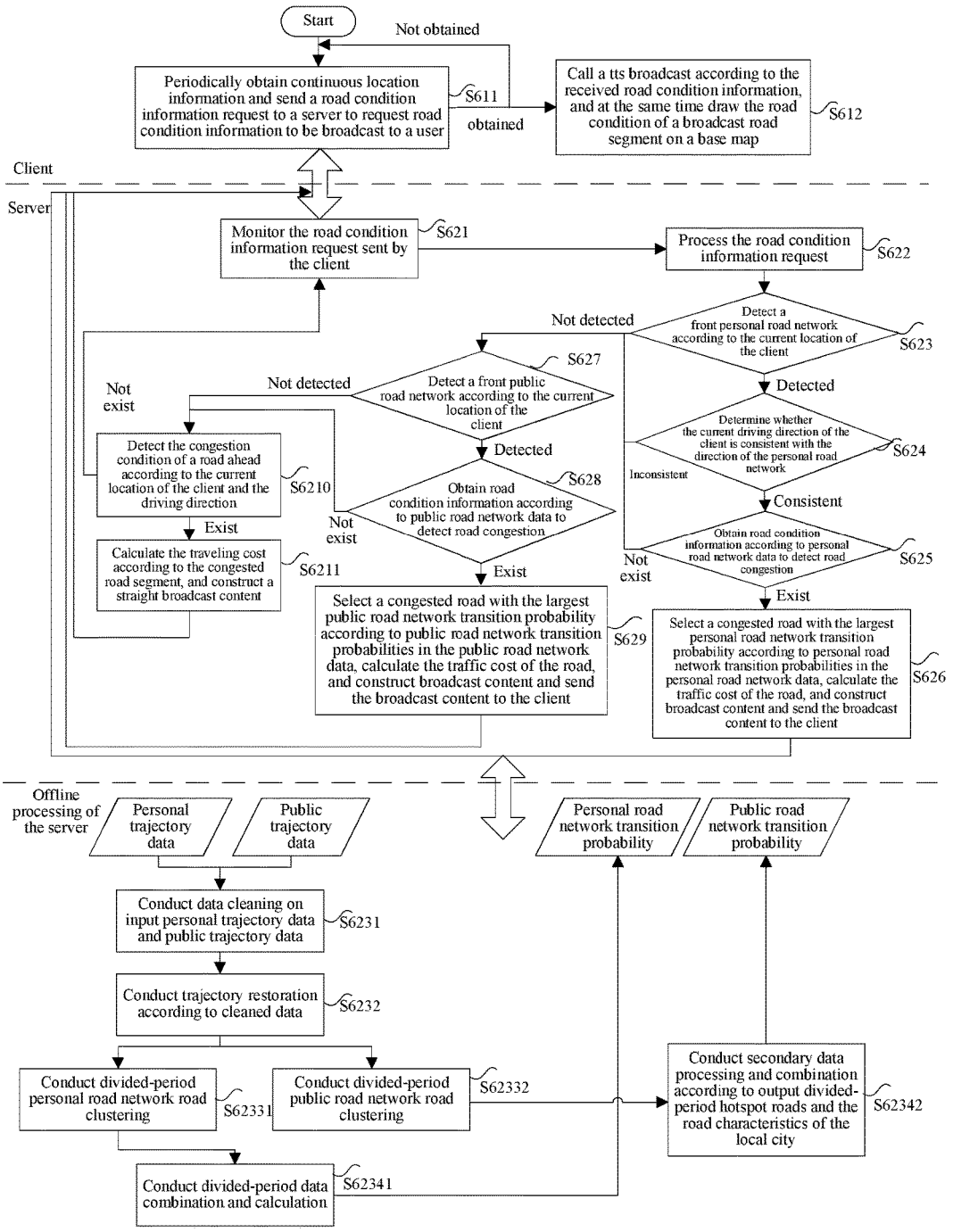
FIG. 8 is a flowchart of a road condition information transmission method according to a preferred embodiment of the present disclosure.

The present disclosure also provides a preferred embodiment. The preferred embodiment is mainly used for road congestion detection and congestion traffic reporting. The processing flow of the preferred embodiment is as shown in FIG. 8. The processing flow of the preferred embodiment may include three major parts, specifically:

The first part is executed by a client. The client here is the first client in the above embodiment of the present disclosure. After starting, the client may perform step S611 to periodically obtain continuous location information and send a road condition information request to a server to request road condition information to be broadcast to a user. If the client obtains the road condition information from the server, the client may perform step S612 to call a tts broadcast according to the received road condition information, and at the same time draw the road condition of a broadcast road segment on a base map. If the client does not obtain the road condition information from the server, the client repeatedly performs step S611.

The second part is executed by the server. The processing flow of the server may comprise the following steps:

Step S621: Monitor the road condition information request sent by the client, and perform step S622 after the road condition information request is monitored.

Step S622: Process the road condition information request, wherein processing may comprise obtaining the current location information of the client from the road condition information request.

Step S623: Detect a front personal road network according to the current location of the client. It should be noted that the personal road network here refers to recorded road segment information stored in the server and reported by the client. When the personal road network is detected, step S624 is performed; when no personal road network is detected, step S627 is performed.

Step S624: Determine whether the current driving direction of the client is consistent with the direction of the personal road network. If yes, step S625 is performed; otherwise, step S627 is performed.

Step S625: Obtain road condition information according to personal road network data pre-stored in the server to detect road congestion. Step S626 is performed when there is congestion; step S627 is performed when there is no congestion.

Step S626: Select a congested road with the largest personal road network transition probability according to personal road network transition probabilities in the personal road network data, calculate the traffic cost of the road, and construct broadcast content and send the broadcast content to the client. It should be noted here that the personal road network transition probability refers to a ratio of the number of recording times of each candidate subsequent road segment in the first-type road segment information in the above embodiments of the present disclosure to the total number of recording times of all candidate subsequent road segments; the higher the personal road network transfer probability of a road segment is, the higher the number of recording times of the road segment is.

Step S627: Detect a front public road network according to the current location of the client. It should be noted that the public road network here refers to the recorded road segment information stored in the server and reported by other clients. When the public road network is detected, step S628 is performed; when no public road network is detected, step S6210 is performed.

Step S628: Obtain road condition information according to public road network data pre-stored in the server to detect road congestion. Step S629 is performed when there is congestion; step S6210 is performed when there is no congestion.

Step S629: Select a congested road with the largest public road network transition probability according to public road network transition probabilities in the public road network data, calculate the traffic cost of the road, and construct broadcast content and send the broadcast content to the client. It should be noted here that the public road network transition probability refers to a ratio of the number of recording times of each candidate subsequent road segment in the second-type road segment information in the above embodiments of the present disclosure to the total number of recording times of all candidate subsequent road segments; the higher the public road network transfer probability of a road segment is, the higher the number of recording times of the road segment is.

Step S6210: Detect the congestion condition of a road ahead according to the current location of the client and the driving direction. When there is congestion, step S6211 is performed; when there is no congestion, step S621 is performed again, that is, continue to monitor the road condition information request sent by the client.

Step S6211: Calculate the traveling cost according to the congested road segment, and construct a straight broadcast content.

The third part is performed by the server. The third part is offline processing of the server, mainly to obtain the personal road network transition probability and the public road network transition probability in different time periods. The third part can periodically push data to the second part. Specifically, the third part comprises the following steps:

Step S6231: Conduct data cleaning on input personal trajectory data and public trajectory data.

Step S6232: Conduct trajectory restoration according to cleaned data. After restoration, step S62331 and step S62332 are performed.

Step S62331: Conduct divided-period personal road network road clustering. After clustering, step S62341 is performed.

Step S62341: Conduct divided-period data combination and calculation to obtain divided-period personal road network transition probability.

Step S62332: Conduct divided-period public road network road clustering. After clustering, step S62342 is performed.

Step S62342: Conduct secondary data processing and combination according to output divided-period hotspot roads and the road characteristics of the local city, so as to obtain a divided-period public road network transition probability.

The preferred embodiment can calculate the personal road network transition probability and the public road network transition probability based on the historical trajectories of individuals and the public. When the user travels by car, the content of a road condition broadcast is affected according to the personal road network transition probability and the public road network transition probability. The road condition broadcast is made to be more in line with the requirement of the user for travel information acquisition in the state of cruising.

For example:

As shown in FIG. 3, O is the start point and D is the end point. When the user is driving on road segment A, there are three types of passable road segments a->b; a->f; a->d. During traditional road condition broadcasting, because no historical route of the user is used as a basis, the road condition of the road ahead will be broadcast, and the user will be notified of congestion information of the road segment b.

When the personal road network transition probability is introduced, through the inspection of the transition probability between road segments, it is found that the user has an 80% probability of turning right from the road segment A to the road segment f during the time period. At this time, a priority will be given to reporting the congestion condition of the road segments f and h.

When the user drives on a strange road, the personal road network transition probability can not be obtained at this time, but in order to avoid the interference with the user by invalid information, the public road network transition probability is introduced, and the principle is the same as that when road condition broadcasting is conducted by means of the personal road network transition probability. During broadcasting, the public road network transition probability of the road ahead is detected, if it is found that 80% of users will choose to turn right to the road segment fat the intersection ahead, we will give a priority to broadcasting the congestion condition of the road segment f during road condition broadcasting, so as to increase the probability of meeting user needs.

It should be noted that when the road condition information of the target subsequent road segment sent to the first client can not satisfy the user needs, and the road condition information of the road ahead sent to the user according to the technical solution provided by the preferred embodiment of the present disclosure can not satisfy the user needs either, the present disclosure provides a function in the first client for the user to manually select a target subsequent road segment, for example, manually inputting a target subsequent road segment, dragging a base map, and the like. When the first client detects that the user manually selects a target subsequent road segment, the first client may directly request the server for the road condition information of the target subsequent road segment. The above function settings can better meet the user needs, so as to achieve the purpose of improving user experience.

It should be noted that for each of the foregoing method embodiments, for the sake of simple description, they are all expressed as a series of action combinations, but those skilled in the art should understand that the present disclosure is not limited by the described action sequence, because according to the present disclosure, certain steps may be performed in other sequences or simultaneously. Secondly, those skilled in the art should also understand that the embodiments described in the specification all belong to preferred embodiments, and the involved actions and modules are not necessarily required by the present disclosure.

Through the description of the above embodiments, those skilled in the art can clearly understand that the method according to the above embodiment can be implemented by means of software plus a necessary general hardware platform, of course, hardware can also be used, but in many cases, the former is a preferred implementation mode. Based on such understanding, the technical solution of the present disclosure may be essentially, or the part which contributes to the existing technology may be embodied in the form of a software product, and the computer software product is stored in a storage medium (such as a ROM/RAM, a magnetic disk and an optical disk) and comprises a plurality of instructions for causing one terminal device (which may be mobile phones, computers, servers or network devices, etc.) to perform the methods described in the various embodiments of the present disclosure.

Embodiment 2

Figure 9:
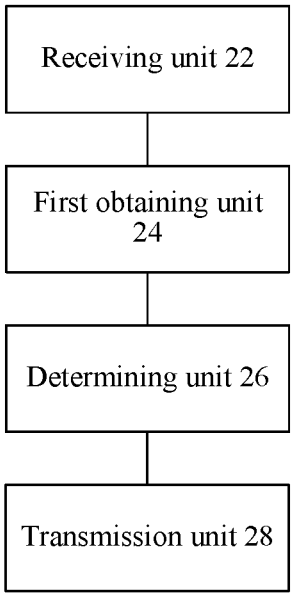
FIG. 9 is a schematic diagram of an alternative road condition information transmission apparatus according to the embodiments of the present disclosure.

According to the embodiments of the present disclosure, a road condition information transmission apparatus for implementing the above road condition information transmission method is provided. FIG. 9 is a schematic diagram of an alternative road condition information transmission apparatus according to the embodiments of the present disclosure. As shown in FIG. 9, the apparatus may comprise:

A receiving unit 22, configured to receive a road condition information request sent by a first client, the road condition information request being used to request road condition information; a first obtaining unit 24, configured to obtain a current location of the first client; a determining unit 26, configured to determine a target subsequent road segment from a plurality of candidate subsequent road segments of the current location, the target subsequent road segment being determined according to recorded road segment information; and a transmission unit 28, configured to transmit road condition information of the target subsequent road segment to the first client.

It should be noted that the receiving unit 22 in this embodiment may be used to perform step S202 in embodiment 1 of the present application, the first obtaining unit 24 in this embodiment may be used to perform step S204 in embodiment 1 of the present application, the determining unit 26 in this embodiment may be used to perform step S206 in embodiment 1 of the present application, and the transmission unit 28 in this embodiment may be used to perform step S208 in embodiment 1 of the present application.

In the receiving unit 22, the embodiments of the present disclosure do not specifically limit the type of the first client, for example, the first client may be an application client. The first client may be installed in a terminal device. The embodiments of the present disclosure do not specifically limit the type of the terminal device where the first client is located either, for example, the terminal device may be a mobile phone, a tablet computer and the like. The first client may have functions such as map navigation and road condition information broadcasting, such as a vehicle navigation application. The first client may also have communication functions including wired communication and wireless communication, such as Bluetooth and WiFi. The first client can use the communication functions to communicate with the server for data exchange and information transfer. The first client may send a road condition information request to the server by communicating with the server, wherein the road condition information request may be used to request road condition information. It should be noted that the road condition information request sent by the first client has a real-time nature, that is, the road condition information requested by the road condition information request is real-time road condition information. The real-time nature of the road condition information request may be reflected by the real-time nature of the location information of the first client. The road condition information requested by the road condition information request sent by the first client to the server is the road condition information corresponding to the current location of the first client, and when the location information of the first client changes, the road condition information requested by the road condition information request is also updated in real time accordingly.

In an actual application scenario, the first client may be automatically triggered to send the road condition information request to the server to obtain real-time road condition information when being started, alternatively, the first client may also detect the touch operation performed by the user in real time after being started and initialized, and is triggered to send the road condition information request to the server after detecting the touch operation performed by the user. For example, the first client is a map application installed in a mobile phone. After the user starts the map application, the map application may detect the touch operation performed by the user in a screen of the mobile phone in real time. The touch operation may include, but is not limited to, clicking (for example, single click and double clicks), long press, gesture, swipe, drag of a base map, and so on. When the map application detects any one of the touch operation described above, a road condition information request may be sent to the server.

In the first obtaining unit 24, after receiving the road condition information request sent by the first client, the server may obtain the current location of the first client by using a GPS positioning module. It should be noted that the GPS positioning module may be located in the terminal device where the first client is located, or may be embedded in the first client as a functional program code, and the server obtains the current location of the first client by receiving coordinate information reported by the GPS positioning module in real time. Alternatively, the road condition information request sent by the first client may carry the current location information of the first client. After receiving the road condition information request sent by the first client, the server may parse the road condition information request, so as to obtain the current location of the first client therefrom. It should be noted that the embodiments of the present disclosure do not specifically limit the way of obtaining the current location of the first client, and the current location of the first client may also be obtained through other ways, which will not be described here by way of example.

In the determining unit 26, a large amount of recorded road segment information may be pre-stored in the server, and a plurality of road segments may be recorded in the recorded road segment information. These road segments may be road segments already completed by the first client, or road segments completed by other clients, or a set of road segments completed by the first client and other clients. The road segments recorded in the recorded road segment information may be marked by identifiers. For example, as shown in FIG. 3, ten road segments are recorded in the recorded road segment information, and the road segments are represented by a, b, c, d, e, f, h, j and k respectively. The attribute parameters of each road segment may be recorded in the recorded road segment information, and the attribute parameters of each road segment may include, but are not limited to, the length of the road segment, the number of recording times of the road segment and the like. For example, as shown in FIG. 3, the number of recording times of the road segment b is 15, the length is 200 meters, the number of recording times of the road segment d is 5, the length is 150 meters, the number of recording times of the road segment f is 80, and the length is 100 meters. It should be noted here that the number of recording times and length of other road segments are not shown in FIG. 3.

Figure 10:
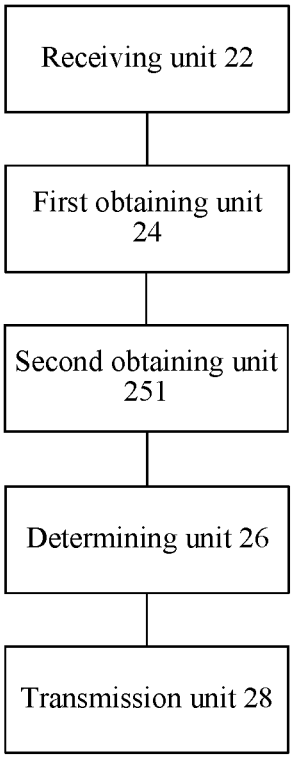
FIG. 10 is a schematic diagram of another alternative road condition information transmission apparatus according to the embodiments of the present disclosure.

After the current location of the first client is obtained, a plurality of candidate subsequent road segments of the current location of the first client may be determined according to the recorded road segment information. It should be noted that the embodiments of the present disclosure provide the following two alternative road condition information transmission apparatuses, specifically:

As an alternative embodiment, as shown in FIG. 10, the road condition information transmission apparatus of this embodiment may further comprise: a second obtaining unit 251, configured to obtain destination information before the target subsequent road segment is determined from the plurality of candidate subsequent road segments of the current location, and determine the plurality of candidate subsequent road segments according to the current location and the destination information. It should be noted that the destination information may be location information preset by the user in the first client. After a destination is determined, all passable routes from the current location of the first client to the destination may be obtained according to the recorded road segment information, and then the plurality of candidate subsequent road segments of the current location of the first client can be determined based on these passable routes. For example, as shown in FIG. 3, assuming that 0 is a start point, D is an end point and the current location of the first client is located on road segment a, all passable routes from the current location of the first client to the end point D are a-b-c, a-f-h and a-f-i-k, and according to these passable routes, it can be determined that the candidate subsequent road segments of the current location of the first client are road segment b and road segment f respectively. It should be noted that the foregoing apparatus is more applicable to the case when a destination is known in advance.

Figure 11:
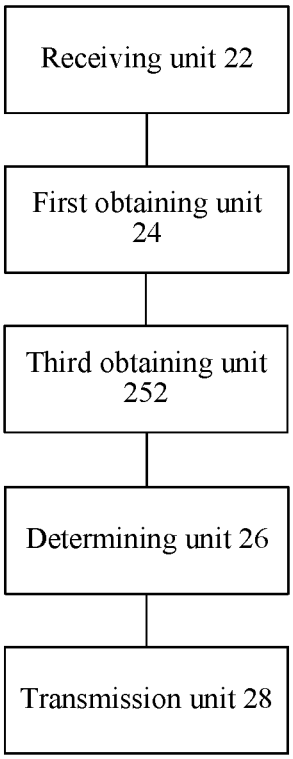
FIG. 11 is a schematic diagram of another alternative road condition information transmission apparatus according to the embodiments of the present disclosure.

As an alternative embodiment, as shown in FIG. 11, the road condition information transmission apparatus of this embodiment may further comprise: a third obtaining unit 252, configured to obtain a driving direction of the first client before the target subsequent road segment is determined from the plurality of candidate subsequent road segments of the current location, and determine the plurality of candidate subsequent road segments according to the current location and the driving direction. It should be noted that the driving direction of the first client may be obtained by obtaining the location information at the first moment and the second moment, and taking the direction from the location where the first client is located at the first moment to the location where the first client is located at the second moment as the driving direction of the first client. After determining the driving direction of the first client, a plurality of passable road segments indicated by the driving direction of the first client may be determined as the plurality of candidate subsequent road segments of the current location of the first client. For example, as shown in FIG. 3, assuming that the current location of the first client is located on road segment a and the driving direction is as indicated by the arrow in the figure, it can be determined that the passable road segments indicated by the driving direction include road segment b, road segment d, and road segment f, and the plurality of candidate subsequent road segments of the current location of the first client are road segment b, road segment d, and road segment f. It should be noted that the foregoing apparatus is more applicable to the case when a destination is unknown in advance.

It should be noted that after the plurality of candidate subsequent road segments of the current location of the first client are determined, a target subsequent road segment may be determined from the plurality of candidate subsequent road segments according to the attribute parameters of each candidate subsequent road segment in the recorded road segment information, wherein the target subsequent road segment is the next driving road segment of the first client, and the attribute parameters of each road segment that can be recorded in the recorded road segment information may include the length of the road segment, the number of recording times of the road segment and the like. The length of the road segment can affect the driving time and fuel consumption of the first client, and the user tends to select a road segment with a shorter distance during actual driving. The number of recording times of the road segment can be used to indicate the probability that the user selects the road segment, that is, the larger the number of recording times of the road segment is, the higher the probability that the user will select the road segment during actual driving is.

As an alternative embodiment, the determination of the target subsequent road segment according to recorded road segment information by the determining unit 26 may comprise: obtaining the length of each candidate subsequent road segment in the recorded road segment information; and determining a candidate subsequent road segment having the shortest length as the target subsequent road segment. For example, as shown in FIG. 3, assuming that the current location of the first client is located on road segment a, the plurality of candidate subsequent road segments of the current location of the first client determined based on the recorded road segment information are road segment b, road segment d, and road segment f, the length of the road segment b is 200 meters, the length of the road segment d is 150 meters, the length of the road segment f is 100 meters, and then it can be determined that the target subsequent road segment is the road segment f having the shortest length by referring to the attribute parameter, road segment length. The target subsequent road segment determined by the determining unit 26 has the shortest length, so that driving time can be effectively shortened and fuel consumption can be reduced.

Figure 12:
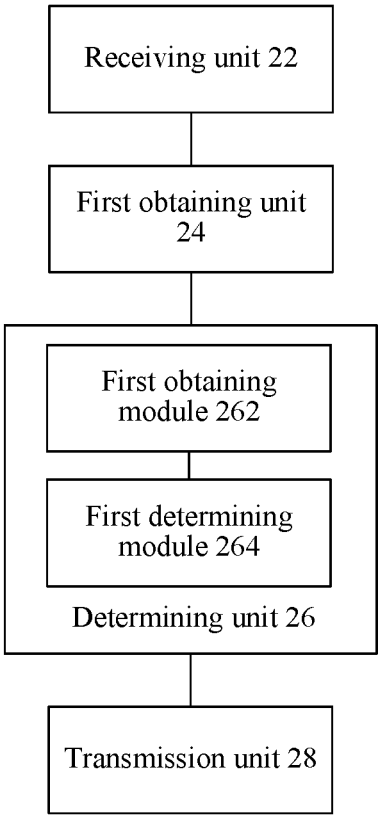
FIG. 12 is a schematic diagram of another alternative road condition information transmission apparatus according to the embodiments of the present disclosure.

As another alternative embodiment, as shown in FIG. 12, the determining unit 26 may comprise: a first obtaining module 262, configured to obtain the number of recording times of each candidate subsequent road segment in the recorded road segment information; and a first determining module 264, configured to determine a candidate subsequent road segment having the largest number of recording times as the target subsequent road segment. For example, as shown in FIG. 3, assuming that the current location of the first client is located on road segment a, the plurality of candidate subsequent road segments of the current location of the first client determined based on the recorded road segment information are road segment b, road segment d, and road segment f, the number of recording times of the road segment b is 15, the number of recording times of the road segment d is 5, the number of recording times of the road segment f is 80, and then it can be determined that the target subsequent road segment is the road segment f having the largest number of recording times by referring to the attribute parameter, the number of recording times. The target subsequent road segment determined by the determining unit 26 has the largest number of recording times, which is more in line with the travel habits and travel requirements of the user.

It should be noted that in the actual application scenario, the target subsequent road segment may be determined by any one of the foregoing two alternative embodiments according to actual requirements. However, considering that there may be a plurality of target subsequent road segments determined by using a single attribute parameter, for example, it is determined that a plurality of candidate subsequent road segments having the shortest length exist in the plurality of candidate subsequent subsequent road segments of the current location of the first client according to the attribute parameter, road segment length, at this time, in the embodiment of the present disclosure, the numbers of recording times of the plurality of candidate subsequent road segments having the shortest length can be obtained from the recorded road segment information, and a candidate subsequent road segment having the largest number of recording times is selected from the plurality of candidate subsequent road segments having the shortest length as the target subsequent road segment according to the number of recording times of road segments. It should be noted that if there are a plurality of candidate subsequent road segments having the largest number of recording times in the plurality of candidate subsequent road segments having the shortest length, any one of the candidate subsequent road segments can be randomly selected as the target subsequent road segment.

Figure 13:
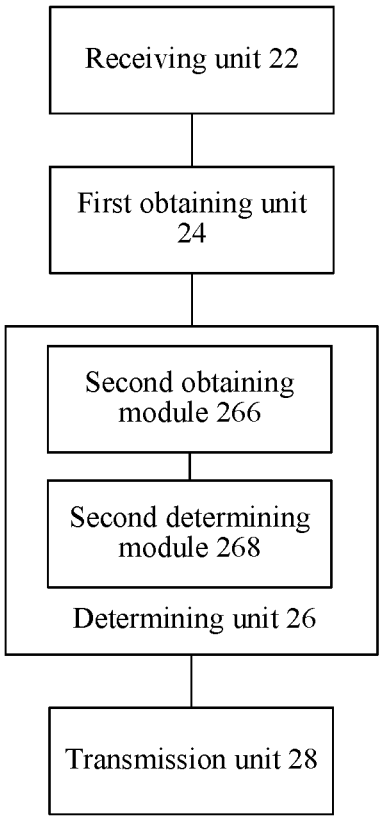
FIG. 13 is a schematic diagram of another alternative road condition information transmission apparatus according to the embodiments of the present disclosure.

As an alternative embodiment, if there are a plurality of candidate subsequent road segments having the largest number of recording times, as shown in FIG. 13, the determining unit 26 may comprise: a second obtaining module 266, configured to obtain, from the recorded road segment information, the length of each of the plurality of candidate subsequent road segments having the largest number of recording times; and a second determining module 268, configured to determine a candidate subsequent road segment having the shortest length in the plurality of candidate subsequent road segments having the largest number of recording times as the target subsequent road segment. It is determined that a plurality of candidate subsequent road segments having the the largest number of recording times exist in the plurality of candidate subsequent subsequent road segments of the current location of the first client according to the attribute parameter, the number of recording times, at this time, in the embodiment of the present disclosure, the length of each of the plurality of candidate subsequent road segments having the largest number of recording times can be obtained from the recorded road segment information, and a candidate subsequent road segment having the shortest length is selected from the plurality of candidate subsequent road segments having the largest number of recording times as the target subsequent road segment according to road segment length. It should be noted that if there are a plurality of candidate subsequent road segments having the shortest length in the plurality of candidate subsequent road segments having the largest number of recording times, any one of the candidate subsequent road segments can be randomly selected as the target subsequent road segment.

In the embodiments of the present disclosure, the target subsequent road segment determined by the determining unit 26 has higher accuracy and is more in line with the actual needs of the user. The road condition information of the target subsequent road segment determined by the determining unit 26 and transmitted to the user is more accurate, and is more in line with the actual needs of the user.

It should also be noted that the number of recording times of each candidate subsequent road segment in the recorded road segment information may also be expressed in the form of transition probability, and the transition probability of each candidate subsequent road segment relative to the current road segment may be the ratio of the number of recording times of the candidate subsequent road segment to the total number of recording times of all candidate subsequent road segments. For example, as shown in FIG. 3, assuming that the current location where the first client is located is road segment a, the candidate subsequent road segments of the current location determined according to the recorded road segment information are b, d and f, and the numbers of recording times are 15, 5 and 80 respectively (corresponding transition probabilities are 0.15, 0.05 and 0.8 respectively). It should be noted that FIG. 3 only shows the numbers of recording times of the candidate subsequent road segments and does not show the transition probabilities of the candidate subsequent road segments relative to the current location.

In the embodiment of the present disclosure, the target subsequent road segment is determined from the plurality of candidate subsequent road segments of the current location of the first client according to the recorded road segment information, so as to obtain the road condition information of the target subsequent road segment of the current location in a targeted mode when responding to the road condition information request sent by the first client, thereby avoiding excessive useless interference road condition information caused by sending of the road condition information of surrounding roads to the first client, also avoiding system source waste caused by too much road condition information to be searched for, and solving the problem of low road condition information accuracy caused by sending of the road condition information of the road ahead to the first client, and accordingly, the technical effects of sending road condition information to the first client in a targeted mode and improving the accuracy of the road condition information sent to the first client are realized.

In the transmission unit 28, after determining the target subsequent road segment of the current location of the first client, the server can obtain the road condition information of the target subsequent road segment in a targeted mode. The obtaining of the road condition information of the target subsequent road segment by the server may include, but is not limited to, judging whether the target subsequent road segment is congested; and calculating traffic cost in the case that the target subsequent road segment is congested, including congestion length, congestion time and the like. Specifically, the following method may be used to determine whether the target subsequent road segment is congested: the server may locate a client whose current location is located on the target subsequent road segment through location information sent by clients, and obtain the location change of the client within a preset time period; if the location of the client does not change significantly or the moving length is lower than a predetermined threshold within the preset time period, it can be determined that the current target subsequent road segment is congested, wherein the preset time period may be set or adjusted according to actual conditions, for example, 20 seconds, 1 minute and the like. The predetermined threshold may also be set or adjusted according to actual conditions, such as 5 meters, 10 meters and the like. The following method may be used to calculate the traffic cost in the case that the target subsequent road segment is congested: when it is detected that the location of the client does not change significantly or the moving length is less than the predetermined threshold within the preset time period, timing starts, timing ends when it is detected that the location of the client changes significantly or the moving length is not less than the predetermined threshold within the preset time period, and the accumulated duration can be used as the congestion time. The distance from the location of the client when timing starts to the location of the client when timing ends can be used as the congestion length. It should be noted that the above methods for determining whether the target subsequent road segment is congested and calculating the traffic cost in the case of congestion are only an alternative embodiment of the present disclosure. The present disclosure may also use other methods to determine whether the target subsequent road segment is congested and calculate the traffic cost in the case of congestion, which will not be described here by way of example. It should also be noted that when the target subsequent road segment is congested, the traffic cost is not limited to the congestion length and congestion time, but may include other contents, which will not be described here by way of example either.

After obtaining the road condition information of the target subsequent road segment, the server may transmit the road condition information of the target subsequent road segment to the first client by communicating with the first client, so as to achieve the purpose of responding to the road condition information request sent by the first client. It should be noted that when the server detects that the target subsequent road segment is congested, the road condition information of the target subsequent road segment transmitted to the first client may include congestion condition, traffic cost and the like; when the server detects that the target subsequent road segment is not congested, the road condition information of the target subsequent road segment transmitted to the first client may include a notification message such as "smooth road" and the like. After receiving the road condition information of the target subsequent road segment transmitted by the server, the first client may broadcast the road condition information in the form of voice broadcast so that the user can learn the road condition information of the target subsequent road segment in time, so as to improve the travel efficiency of the user.

Considering that the travel routes of the user have a certain rule based on time during actual application, for example, during the morning peak hours in working days, the travel route of the user is mainly the route from home to company. Therefore, the recorded road section information stored in the server of the embodiment of the present disclosure may also be used to indicate the recording time of the road section. Correspondingly, during determination of the target subsequent road segment from the plurality of candidate subsequent road segments of the current location of the first client according to the recorded road segment information, the embodiments of the present disclosure also consider the time factor.

Figure 14:
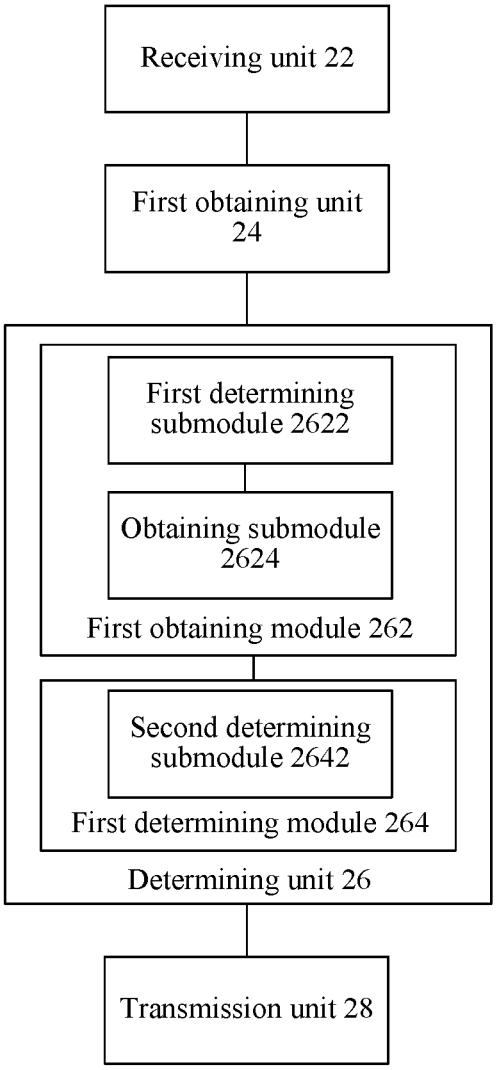
FIG. 14 is a schematic diagram of another alternative road condition information transmission apparatus according to the embodiments of the present disclosure.

For example, when the target subsequent road segment is determined by taking the number of recording times of the recorded road segments in the recorded road segment information as the reference factor, as an alternative embodiment, as shown in FIG. 14, the first obtaining module 262 may comprise: a first determining submodule 2622, configured to determine a time period to which the time at which the road condition information request is received belongs; and an obtaining submodule 2624, configured to obtain the number of recording times of each candidate subsequent road segment within the time period. Correspondingly, the first determining module 264 comprises: a second determining submodule 2642, configured to determine a candidate subsequent road segment having the largest number of recording times within the time period as the target subsequent road segment.

It should be noted that the server may record a receiving time when receiving the road condition information request sent by the first client, and determine the time period to which the receiving time belongs. It should be noted here that the server may divide time into a plurality of different time periods according to the actual situation, for example, morning peak hours in working days 07:00-10:00, dining time 11:30-12:30 and evening peak hours 17:00-20:00 and so on. For example, when the server receives the road condition information request sent by the first client at 08:00, the server may determine that the receiving time belongs to the morning peak hours 07:00-10:00. The recording time of each candidate subsequent road segment in the recorded road segment information stored in the server may vary. After determining the time period to which the time at which the road condition information request is received belongs, the server may obtain the number of recording times of each candidate subsequent road segment in the recorded road segment information within the time period, and take the candidate subsequent road segment having the largest number of recording times within the time period as the target subsequent road segment, so as to realize the purpose of determining the target subsequent road segment from the plurality of candidate subsequent road segments of the current location of the first client according to the recorded road segment information.

For example, as shown in FIG. 3, assuming that the current location of the first client is located on road segment a, the candidate subsequent road segments of the current location determined according to the recorded road segment information are b, d and f, the numbers of occurrences thereof are 15, 5 and 80 respectively, and the times of occurrences are 08:00, 05:00 and 09:15 respectively. Assuming that the server receives the road condition information request sent by the first client at 07:30 which belongs to the morning peak hours 07:00-10:00, the server first selects candidate subsequent road segments b and f with the recording time within the morning peak hours 07:00-10:00, and then the numbers of recording times of the candidate subsequent road segments b and f are compared to find that the number of recording times of the candidate subsequent road segment f is the largest, so the candidate subsequent road segment f is determined as the target subsequent road segment of the current location of the first client within the morning peak hours 07:00-10:00.

In the embodiment of the present disclosure, by determining the time period to which the time at which the road condition information request is received belongs, and determining the target subsequent road segment of the current location of the first client within the time period, the determined target subsequent road segment can be more in line with the travel rule of the user, thereby realizing the technical effect of improving the accuracy of the determined target subsequent road segment so as to improve the accuracy of the road condition information of the target subsequent road segment sent to the first client.

As an alternative embodiment, the recorded road segment information stored in the server may include first-type road segment information and/or second-type road segment information, wherein the first-type road segment information may be reported by the first client and may record the road segments reported by the first client and the attribute parameters of each road segment; the second-type road segment information may be reported by at least one second client and may record the road segments reported by the at least one second client and the attribute parameters of each road segment. It should be noted that "first" and "second" here are used only to distinguish different clients, and the order of the clients is not specifically limited. The types of the second client and the first client may be the same or different, which is not specifically limited in the embodiments of the present disclosure, for example, the second client may also be an application client. The second client may also be installed in a terminal device such as a mobile phone or a tablet computer, and may also have functions such as map navigation and road condition information broadcasting, such as the Tencent map application and a vehicle navigation application. The second client may also have communication functions including wired communication and wireless communication such as Bluetooth and WiFi. The second client can use the communication functions to communicate with the server for data exchange and information transfer, for example, reporting the second-type road segment information to the server.

It should be noted that, in the case that the recorded road segment information only includes the first-type road segment information, the embodiments of the present disclosure may determine the target subsequent road segment from the plurality of candidate subsequent road segments of the current location of the first client according to the first-type road segment information, for example, the method may specifically comprise: obtaining the number of recording times of each candidate subsequent road segment in the first-type road segment information; and determining a candidate subsequent road segment having the largest number of recording times as the target subsequent road segment.

In the case that the recorded road segment information only includes the second-type road segment information, the embodiments of the present disclosure may determine the target subsequent road segment from the plurality of candidate subsequent road segments of the current location of the first client according to the second-type road segment information, for example, the method may specifically comprise: obtaining the number of recording times of each candidate subsequent road segment in the second-type road segment information; and determining a candidate subsequent road segment having the largest number of recording times as the target subsequent road segment.

Figure 15:
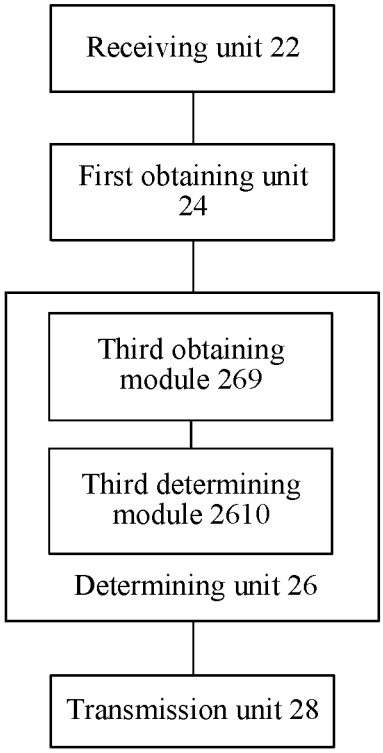
FIG. 15 is a schematic diagram of another alternative road condition information transmission apparatus according to the embodiments of the present disclosure.

In the case that the recorded road segment information includes the first-type road segment information and the second-type road segment information, during the determination of the target subsequent road segment according to the recorded road segment information, the embodiments of the present disclosure may determine the target subsequent road segment according to the first-type road segment information first, as shown in FIG. 15, the determining unit 26 may comprise: a third obtaining module 269, configured to obtain the number of recording times of each candidate subsequent road segment in the first-type road segment information; and a third determining module 2610, configured to determine a candidate subsequent road segment having the largest number of recording times as the target subsequent road segment. If the target subsequent road segment can not be determined according to the first-type road segment information, for example, the current location of the first client is not recorded in the first-type road segment information, or the target subsequent road segment determined according to the first-type road segment information does not meet the predetermined requirement, for example, the first-type road segment information is little, the accuracy of the target subsequent road segment determined by using the first-type road segment information is low, the embodiments of the present disclosure may determine the target subsequent road segment according to the second-type road segment information.

It should be noted that in the case that the recorded road segment information includes the first-type road segment information and the second-type road segment information, in principle, the target subsequent road segment may be determined according to the first-type road segment information or the second-type road segment information. However, in order to make the determined target subsequent road segment more consistent with user requirements of the first client, the embodiments of the present disclosure preferably set the priority of the determination of the target subsequent road segment according to the first-type road segment information to be higher than the priority of the determination of the target subsequent road segment according to the second-type road segment information, that is, the target subsequent road segment is determined according to the first-type road segment information first, in this way, the determined target subsequent road segment can be more consistent with user requirements of the first client, thereby improving the accuracy of the determined target subsequent road segment, and the technical effect of improving the accuracy of the road condition information of the target subsequent road segment sent to the first client is realized.

Figure 16:
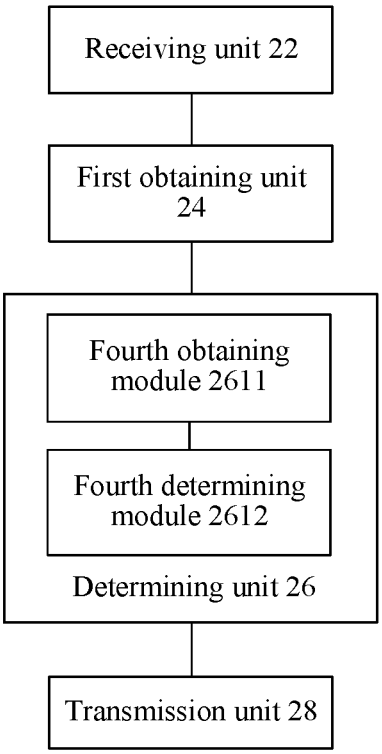
FIG. 16 is a schematic diagram of another alternative road condition information transmission apparatus according to the embodiments of the present disclosure.

It should also be noted that, for the case when the recorded road segment information includes the first-type road segment information and the second-type road segment information, the situation that the target subsequent road segment can not be determined according to the first-type road segment information or the target subsequent road segment determined according to the first-type road segment information does not meet the predetermined requirement may be specified by the following alternative embodiments:

As an alternative embodiment, in the case that the recorded road segment information includes the first-type road segment information and the second-type road segment information, if the number of recording times of each candidate subsequent road segment in the first-type road segment information is less than the predetermined threshold, as shown in FIG. 16, the determining unit 26 may comprise: a fourth obtaining module 2611, configured to obtain the number of recording times of each candidate subsequent road segment in the second-type road segment information; and a fourth determining module 2612, configured to determine a candidate subsequent road segment having the largest number of recording times as the target subsequent road segment. It should be noted that the predetermined threshold may be set or adjusted according to actual situations, which is not specifically limited in the embodiments of the present disclosure, for example, the predetermined threshold may be 10, 15 and the like.

For example, as shown in FIG. 4, assuming that the current location of the first client is located at road segment a, the road segments a, b, c, d, e, and g recorded in the first-type road segment information are represented by solid lines, and the candidate subsequent road segments of the current location are b and d. The road segments a, f, h, i, j, k, l, m and n recorded in the second-type road segment information are represented by dotted lines, and the candidate subsequent road segments of the current location are f and l. For the above situation, in principle, the embodiments of the present disclosure may select the target subsequent road segment from the candidate subsequent road segments b and d according to the first-type road segment information. However, the numbers of recording times of the road segments b and d in the first-type road segment information are small, 3 and 5 respectively. Assuming that the predetermined threshold is 10, it is found through comparison that the number of recording times of each candidate subsequent road segment in the first-type road segment information is less than the predetermined threshold, then the target subsequent road segment is determined from the candidate subsequent road segments f and l according to the second-type road segment information, as shown in FIG. 4, the numbers of occurrences of the candidate subsequent road segments f and l in the second-type road segment information are 80 and 100 respectively, and by means of the method for determining the target subsequent road segment from the plurality of candidate subsequent road segments according to the second-type road segment information, the road segment l having the largest number of recording times is determined as the target subsequent road segment.

In the embodiments of the present disclosure, when the target subsequent road segment is determined from the plurality of candidate subsequent road segments according to the first-type road segment information in the above-mentioned case, if the number of recording times of each candidate subsequent road segment in the first-type road segment information is less than the predetermined threshold, it indicates that the first-type road segment information is little, and if the first-type road segment information is used as a basis for determining the target subsequent road segment, deviations may occur and the determined target subsequent road segment is not accurate enough. At this time, the embodiments of the present disclosure may determine the target subsequent road segment from the plurality of candidate subsequent road segments according to the second-type road segment information, and a candidate subsequent road segment having the largest number of recording times in the second-type road segment information is determined as the target subsequent road segment, so as to ensure that the determined target subsequent road segment is more accurate, thereby achieving the effect of improving the accuracy of the road condition information of the target subsequent road segment transmitted to the first client.

It should be noted that, in the foregoing cases, during determination of a target subsequent road segment from the plurality of candidate subsequent road segments according to the recorded road segment information, the number of recording times of each candidate subsequent road segment in the recorded road segment information within a time period to which a time at which a road condition information request is received belongs can be obtained, a candidate subsequent road segment having the largest number of recording times within the time period is determined as the target subsequent road segment, so as to ensure the accuracy of the determined target subsequent road segment.

By means of the above modules, the technical problem that in the related technology, the server can only send the road condition information of the road ahead to the client, leading to low accuracy of the road condition information sent to the client is solved, and accordingly the technical effect of improving the accuracy of the road condition information sent to the client is realized.

It should be noted here that the above modules and the corresponding steps implement the same examples and application scenarios, but are not limited to the content disclosed in the above embodiment 1. It should be noted that the above modules may be implemented as part of the apparatus in a hardware environment as shown in FIG. 1, and may be implemented by software or hardware, wherein the hardware environment includes a network environment.

Embodiment 3

According to the embodiments of the present disclosure, a terminal for implementing the foregoing road condition information transmission method is also provided.

Figure 17:
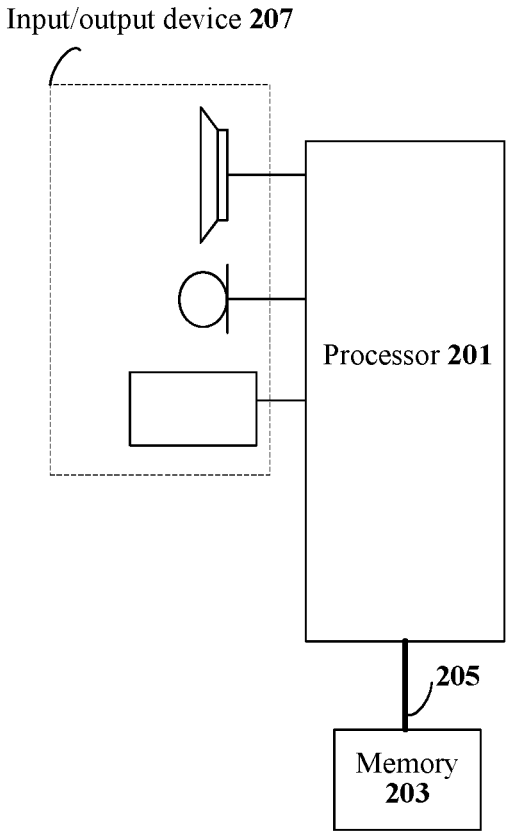
FIG. 17 is a structural block diagram of a terminal according to the embodiments of the present disclosure.

FIG. 17 is a structural block diagram of a terminal according to the embodiments of the present disclosure. As shown in FIG. 17, the terminal may comprise: one or more (only one is shown) processors 201 (processing circuitry), a memory 203, and a transmission device 205. As shown in FIG. 17, the terminal may further comprise an input/output device 207.

The memory 203 can be configured to store software programs and modules, such as program instructions/modules corresponding to the road condition information transmission method and apparatus in the embodiments of the present disclosure. The processor 201 runs the software programs and modules stored in the memory 203 so as to execute various functional applications and data processing, that is, to realize the above-mentioned road condition information transmission method. The memory 203 may be a high-speed random access memory, and may also be a non-volatile memory such as one or more magnetic storage devices, flash memories, or other non-volatile solid-state memories. In some examples, the memory 203 may also be a memory remotely disposed with respect to the processor 201, and these remote memories may be connected to the terminal through a network. Examples of such network include, but are not limited to, the Internet, intranets, local area networks, mobile communication networks, and a combination thereof.

The above-mentioned transmission apparatus 205 is configured to receive or transmit data via a network, and can also be configured to transmit data between the processor and the memory. The above specific examples of network may include wired network and wireless network. In one example, the transmission apparatus 205 comprises a network interface controller (NIC) which can be connected to a router via a network cable and other network devices so as to be able to communicate with the Internet or a local area network. In one example, the transmission apparatus 205 is a Radio Frequency (RF) module for communicating with the Internet in a wireless mode.

Specifically, the memory 203 is configured to store application programs.

The processor 201 may call the application programs stored in the memory 203 through the transmission apparatus 205 to perform the following steps: receiving a road condition information request sent by a first client, the road condition information request being used to request road condition information; obtaining a current location of the first client; determining a target subsequent road segment from a plurality of candidate subsequent road segments of the current location, the target subsequent road segment being determined according to recorded road segment information; and transmitting road condition information of the target subsequent road segment to the first client.

The processor 201 is further configured to perform the following steps: before determining the target subsequent road segment from the plurality of candidate subsequent road segments of the current location, obtaining destination information, and determining the plurality of candidate subsequent road segments according to the current location and the destination information; or obtaining a driving direction of the first client, and determining the plurality of candidate subsequent road segments according to the current location and the driving direction.

The processor 201 is further configured to perform the following steps: obtaining the number of recording times of each candidate subsequent road segment in the recorded road segment information; and determining a candidate subsequent road segment having the largest number of recording times as the target subsequent road segment.

The processor 201 is further configured to perform the following steps: if there are a plurality of candidate subsequent road segments having the largest number of recording times, obtaining, from the recorded road segment information, the length of each of the plurality of candidate subsequent road segments having the largest number of recording times; and determining a candidate subsequent road segment having the shortest length in the plurality of candidate subsequent road segments having the largest number of recording times as the target subsequent road segment.

The processor 201 is further configured to perform the following steps: determining the time period to which the time at which the road condition information request is received belongs; obtaining the number of recording times of each candidate subsequent road segment within the time period; and determining a candidate subsequent road segment having the largest number of recording times within the time period as the target subsequent road segment.

The processor 201 is further configured to perform the following steps: in the case that the recorded road segment information includes first-type road segment information and second-type road segment information, obtaining the number of recording times of each candidate subsequent road segment in the first-type road segment information; and determining a candidate subsequent road segment having the largest number of recording times as the target subsequent road segment.

The processor 201 is further configured to perform the following steps: in the case that the number of recording times of each candidate subsequent road segment in the first-type road segment information is less than a predetermined threshold, obtaining the number of recording times of each candidate subsequent road segment in the second-type road segment information; and determining a candidate subsequent road segment having the largest number of recording times as the target subsequent road segment.

With the embodiments of the present disclosure, a road condition information transmission scheme is provided. By determining the target subsequent road segment from the plurality of candidate subsequent road segments according to the recorded road segment information after receiving the road condition information request, and sending the road condition information of the target subsequent road segment to the first client, the purpose of sending road condition information to the client in a targeted mode is realized, accordingly the technical problem that in the related art, the server can only send the road condition information of the road ahead to the client, leading to low accuracy of the road condition information sent to the client is solved, and the technical effect of improving the accuracy of the road condition information sent to the client is realized.

Alternatively, for specific examples in the present embodiment, reference may be made to the examples described in embodiment 1 and embodiment 2 above, which are not described herein again in this embodiment.

Those of ordinary skill in the art can understand that the structure shown in FIG. 17 is only illustrative, and the terminal may be a smart phone (such as an Android mobile phone, an iOS mobile phone, etc.), a tablet computer, a palmtop computer, a mobile Internet device (MID), a PAD and other terminal devices. FIG. 17 does not limit the structure of the above electronic device. For example, the terminal may also comprise more or less components (such as a network interface, a display device, etc.) than those shown in FIG. 17, or have a configuration different from that shown in FIG. 17.

Those of ordinary skill in the art can understand that all or some of the steps in the various methods of the above embodiments can be accomplished through a program instructing terminal device-related hardware. The program can be stored in a non-transitory computer-readable storage medium, and the storage medium may comprise: a flash disk, a read-only memory (ROM), a random access memory (RAM), a magnetic disk or an optical disk.

Embodiment 4

The embodiments of the present disclosure also provide a storage medium. Alternatively, in the present embodiment, the foregoing storage medium may be used to execute program codes of a road condition information transmission method.

Alternatively, in the present embodiment, the foregoing storage medium may be located on at least one of a plurality of network devices in the network shown in the foregoing embodiment.

Alternatively, in the present embodiment, the storage medium is configured to store program codes for performing the following steps:

S1: Receive a road condition information request sent by a first client, the road condition information request being used to request road condition information.

S2: Obtain a current location of the first client.

S3: Determine a target subsequent road segment from a plurality of candidate subsequent road segments of the current location, the target subsequent road segment being determined according to recorded road segment information.

S4: Transmit road condition information of the target subsequent road segment to the first client.

Alternatively, the storage medium is further configured to store program codes for performing the following steps: before determining the target subsequent road segment from the plurality of candidate subsequent road segments of the current location, obtaining destination information, and determining the plurality of candidate subsequent road segments according to the current location and the destination information; or obtaining a driving direction of the first client, and determining the plurality of candidate subsequent road segments according to the current location and the driving direction.

Alternatively, the storage medium is further configured to store program codes for performing the following steps: obtaining the number of recording times of each candidate subsequent road segment in the recorded road segment information; and determining a candidate subsequent road segment having the largest number of recording times as the target subsequent road segment.

Alternatively, the storage medium is further configured to store program codes for performing the following steps: if there are a plurality of candidate subsequent road segments having the largest number of recording times, obtaining, from the recorded road segment information, the length of each of the plurality of candidate subsequent road segments having the largest number of recording times; and determining a candidate subsequent road segment having the shortest length in the plurality of candidate subsequent road segments having the largest number of recording times as the target subsequent road segment.

Alternatively, the storage medium is further configured to store program codes for performing the following steps: determining a time period to which a time at which the road condition information request is received belongs; obtaining the number of recording times of each candidate subsequent road segment within the time period; and determining a candidate subsequent road segment having the largest number of recording times within the time period as the target subsequent road segment.

Alternatively, the storage medium is further configured to store program codes for performing the following steps: in the case that the recorded road segment information includes first-type road segment information and second-type road segment information, obtaining the number of recording times of each candidate subsequent road segment in the first-type road segment information; and determining a candidate subsequent road segment having the largest number of recording times as the target subsequent road segment.

Alternatively, the storage medium is further configured to store program codes for performing the following steps: in the case that the number of recording times of each candidate subsequent road segment in the first-type road segment information is less than a predetermined threshold, obtaining the number of recording times of each candidate subsequent road segment in the second-type road segment information; and determining a candidate subsequent road segment having the largest number of recording times as the target subsequent road segment.

Alternatively, for specific examples in the present embodiment, reference may be made to the examples described in embodiment 1 and embodiment 2 above, which are not described herein again in this embodiment.

Alternatively, in the present embodiment, the foregoing storage medium may include, but is not limited to, a USB flash disk, a read-only memory (ROM), a random access memory (RAM), a removable hard disk, a magnetic disk, an optical disk and various other media which can store program codes.

The sequence numbers of the foregoing embodiments of the present disclosure are merely for description and do not represent the advantages and disadvantages of the embodiments.

Each integrated unit in the above embodiment may be stored in the aforementioned computer-readable storage medium if it is implemented in the form of a software functional unit and sold or used as a separate product. Based on such understanding, the technical solution may be essentially, or the part of the present disclosure which contributes to the prior art or all or part of the technical solution may be embodied in the form of a software product, and the computer software product is stored in a storage medium and comprises a plurality of instructions for causing one or more computer devices (which may be personal computers, servers or network devices, etc.) to perform all or part of the steps of the methods described in the various embodiments of the present disclosure.

In the foregoing embodiments of the present disclosure, the description of each embodiment has its own emphasis, for the part not described in detail in one embodiment, reference may be made to the relevant description of other embodiments.

In several embodiments provided in the present application, it should be understood that the disclosed client may be implemented in other ways. The device embodiments described above are merely schematic, for example, the division of the units is only one logical function division, and there may be another division manner in actual implementation, for example, multiple units or components may be combined or may be integrated into another system, or some features can be ignored or not implemented. In addition, the illustrated or discussed mutual coupling or direct coupling or communication may be indirect coupling or communication through some interfaces, units or modules, and may be electrical or other forms.

The units described as separate parts may or may not be physically separated, and the parts displayed as units may or may not be physical units, that is, may be located in one place, or may be distributed on multiple network units. Some or all of the units may be selected according to actual needs to achieve the purpose of the solution of this embodiment.

In addition, the functional units in each embodiment of the present disclosure may be integrated in one processing unit, or each unit may exist alone physically, or two or more units may be integrated in one unit. The above integrated unit can be implemented either in the form of hardware or in the form of a software functional unit.

The above description is only preferred embodiments of the present disclosure, and it should be pointed out that those of ordinary skill in the art can make improvements and modifications without departing from the principle of the present disclosure, and these improvements and modifications should also be regarded as the protection scope of the present disclosure.

What is claimed is:

1. A road condition information transmission method, implemented by a road condition information transmission apparatus, comprising:

receiving, by processing circuitry of the road condition information transmission apparatus, a road condition information request sent by a first client, the road condition information request being used to request road condition information;

obtaining, by the processing circuitry, a current location of the first client;

determining, by the processing circuitry, a target subsequent road segment from a plurality of candidate subsequent road segments of the current location, the target subsequent road segment being determined according to recorded road segment information; and transmitting, by the processing circuitry, road condition information of the target subsequent road segment to the first client, wherein the determination of the target subsequent road segment according to recorded road segment information comprises:

obtaining, by the processing circuitry, the number of recording times of each candidate subsequent road segment in the recorded road segment information; and determining, by the processing circuitry, a candidate subsequent road segment having the largest number of recording times as the target subsequent road segment.

2. The method according to claim 1, wherein before determining the target subsequent road segment from a plurality of candidate subsequent road segments of the current location, the method further comprises:

obtaining, by the processing circuitry, destination information, and determining the plurality of candidate subsequent road segments according to the current location and the destination information; or obtaining, by the processing circuitry, a driving direction of the first client, and determining the plurality of candidate subsequent road segments according to the current location and the driving direction.

3. The method according to claim 1, wherein when there are a plurality of candidate subsequent road segments having the largest number of recording times, the determination of the target subsequent road segment according to recorded road segment information comprises:

obtaining, by the processing circuitry, from the recorded road segment information, the length of each of the plurality of candidate subsequent road segments having the largest number of recording times; and determining, by the processing circuitry, a candidate subsequent road segment having the shortest length in the plurality of candidate subsequent road segments having the largest number of recording times as the target subsequent road segment.

4. The method according to claim 1, wherein the obtaining of the number of recording times of each candidate subsequent road segment in the recorded road segment information comprises:

determining, by the processing circuitry, a time period to which a time at which the road condition information request is received belongs; and obtaining, by the processing circuitry, the number of recording times of each candidate subsequent road segment within the time period; and the determination of a candidate subsequent road segment having the largest number of recording times as the target subsequent road segment comprises:

determining, by the processing circuitry, a candidate subsequent road segment having the largest number of recording times within the time period as the target subsequent road segment.

5. The method according to claim 1, wherein the recorded road segment information comprises first-type road segment information and/or second-type road segment information, wherein the first-type road segment information is reported by the first client, and the second-type road segment information is reported by at least one second client.

6. The method according to claim 5, wherein when the recorded road segment information comprises the first-type road segment information and the second-type road segment information, the determination of the target subsequent road segment according to recorded road segment information comprises:

obtaining, by the processing circuitry, the number of recording times of each candidate subsequent road segment in the first-type road segment information; and determining, by the processing circuitry, a candidate subsequent road segment having the largest number of recording times as the target subsequent road segment.

7. The method according to claim 6, wherein when the number of recording times of each candidate subsequent road segment in the first-type road segment information is less than a predetermined threshold, the determination of the target subsequent road segment according to recorded road segment information comprises:

obtaining, by the processing circuitry, the number of recording times of each candidate subsequent road segment in the second-type road segment information; and determining, by the processing circuitry, a candidate subsequent road segment having the largest number of recording times as the target subsequent road segment.

8. A road condition information transmission apparatus, comprising:

processing circuitry configured to receive a road condition information request sent by a first client, the road condition information request being used to request road condition information;

obtain a current location of the first client;

determine a target subsequent road segment from a plurality of candidate subsequent road segments of the current location, the target subsequent road segment being determined according to recorded road segment information; and transmit road condition information of the target subsequent road segment to the first client, wherein the processing circuitry is further configured to obtain the number of recording times of each candidate subsequent road segment in the recorded road segment information; and determine a candidate subsequent road segment having the largest number of recording times as the target subsequent road segment.

9. The apparatus according to claim 8, wherein the processing circuitry is configured to:

before the target subsequent road segment is determined from the plurality of candidate subsequent road segments of the current location, obtain destination information, and determine the plurality of candidate subsequent road segments according to the current location and the destination information; or before the target subsequent road segment is determined from the plurality of candidate subsequent road segments of the current location, obtain a driving direction of the first client, and determine the plurality of candidate subsequent road segments according to the current location and the driving direction.

10. The apparatus according to claim 9, wherein when there are a plurality of candidate subsequent road segments having the largest number of recording times, the processing circuitry is configured to:

obtain, from the recorded road segment information, the length of each of the plurality of candidate subsequent road segments having the largest number of recording times; and determine a candidate subsequent road segment having the shortest length in the plurality of candidate subsequent road segments having the largest number of recording times as the target subsequent road segment.

11. The apparatus according to claim 9, wherein the processing circuitry is configured to:

determine a time period to which a time at which the road condition information request is received belongs;

obtain the number of recording times of each candidate subsequent road segment within the time period; and determine a candidate subsequent road segment having the largest number of recording times within the time period as the target subsequent road segment.

12. The apparatus according to claim 8, wherein the recorded road segment information comprises first-type road segment information and/or second-type road segment information, wherein the first-type road segment information is reported by the first client, and the second-type road segment information is reported by at least one second client.

13. The apparatus according to claim 12, wherein when the recorded road segment information comprises the first-type road segment information and the second-type road segment information, the processing circuitry is configured to:

obtain the number of recording times of each candidate subsequent road segment in the first-type road segment information; and determine a candidate subsequent road segment having the largest number of recording times as the target subsequent road segment.

14. The apparatus according to claim 13, wherein when the number of recording times of each candidate subsequent road segment in the first-type road segment information is less than a predetermined threshold, the processing circuitry is configured to:

obtain the number of recording times of each candidate subsequent road segment in the second-type road segment information; and determine a candidate subsequent road segment having the largest number of recording times as the target subsequent road segment.

15. A road condition information obtaining method, implemented by a road condition information transmission apparatus, comprising:

obtaining, by processing circuitry of the road condition information transmission apparatus, a current location of a first client;

determining, by the processing circuitry, a target subsequent road segment from a plurality of candidate subsequent road segments of the current location, the target subsequent road segment being determined according to recorded road segment information; and obtaining, by the processing circuitry, road condition information of the target subsequent road segment, wherein the determination of the target subsequent road segment according to recorded road segment information comprises:

obtaining, by the processing circuitry, the number of recording times of each candidate subsequent road segment in the recorded road segment information; and determining, by the processing circuitry, a candidate subsequent road segment having the largest number of recording times as the target subsequent road segment.

16. The method according to claim 15, wherein before determining the target subsequent road segment from a plurality of candidate subsequent road segments of the current location, the method further comprises:

obtaining, by the processing circuitry, destination information, and determining the plurality of candidate subsequent road segments according to the current location and the destination information; or obtaining, by the processing circuitry, a driving direction of the first client, and determining the plurality of candidate subsequent road segments according to the current location and the driving direction.

17. A non-transitory computer-readable storage medium storing instructions which when executed by a road condition information transmission apparatus, cause the road condition information transmission apparatus to perform a road condition information transmission method comprising:

receiving, by processing circuitry of the road condition information transmission apparatus, a road condition information request sent by a first client, the road condition information request being used to request road condition information;

obtaining, by the processing circuitry, a current location of the first client determining, by the processing circuitry, a target subsequent road segment from a plurality of candidate subsequent road segments of the current location, the target subsequent road segment being determined according to recorded road segment information; and transmitting, by the processing circuitry, road condition information of the target subsequent road segment to the first client, wherein the determination of the target subsequent road segment according to recorded road segment information comprises:

obtaining, by the processing circuitry, the number of recording times of each candidate subsequent road segment in the recorded road segment information; and determining, by the processing circuitry, a candidate subsequent road segment having the largest number of recording times as the target subsequent road segment.

* * * * *